US006801814B1

(12) United States Patent
Wilson et al.

(10) Patent No.: US 6,801,814 B1
(45) Date of Patent: Oct. 5, 2004

(54) APPARATUS AND METHOD FOR COMPUTERIZED DATA COLLECTION, MONITORING, ANALYSIS, AND CONTROL OF GROUTING OPERATIONS

(75) Inventors: David B. Wilson, Camp Hill, PA (US); Trent L. Dreese, Port Treverton, PA (US); Douglas Heenan, Toronto (CA); James Cockburn, Nobleton (CA)

(73) Assignees: Gannett Fleming, Inc., Camp Hill, PA (US); Advanced Construction Techniques, Ltd, Maple (CA)

( * ) Notice: Subject to any disclaimer, the term of this patent is extended or adjusted under 35 U.S.C. 154(b) by 0 days.

(21) Appl. No.: 10/287,339

(22) Filed: Nov. 4, 2002

Related U.S. Application Data

(60) Provisional application No. 60/335,887, filed on Nov. 2, 2002.

(51) Int. Cl.[7] ..... G06F 17/00; E02D 13/00

(52) U.S. Cl. ..... 700/90; 700/97; 700/108; 702/158; 175/71; 405/232

(58) Field of Search ..... 405/266, 270; 702/188, 182; 73/11.03; 700/108, 90

(56) References Cited

U.S. PATENT DOCUMENTS 5,135,058 A * 8/1992 Millgard et al. ..... 175/71
5,425,268 A * 6/1995 Li et al. ..... 73/19.1
5,978,749 A * 11/1999 Likins et al. ..... 702/158
6,402,432 B1 * 6/2002 England et al. ..... 405/232

FOREIGN PATENT DOCUMENTS

JP 63014922 A * 1/1988 ..... E02D/3/12
JP 2000319866 A * 11/2000 ..... E02D/3/12

* cited by examiner

*Primary Examiner*—Leo Picard
*Assistant Examiner*—Douglas S. Lee
(74) *Attorney, Agent, or Firm*—Kurt L. Ehresman; McNees Wallace & Nurick

(57) ABSTRACT

The present invention is directed to a system and method provided for electronic gathering, monitoring, analyzing, managing, and utilizing of grouting information in order to facilitate and control drilling, testing, installation of grouting materials, and other grouting operations. The present invention permits electronic creation of a grouting plan, initiation of grouting operations pursuant to the plan, and monitoring, manipulation, and control of grouting operations, and storage and retrieval of data from said grouting operations. The apparatus and method utilize electronic apparatus and software to provide graphical user interfaces to monitor and control all phases of grouting operations.

15 Claims, 39 Drawing Sheets

Grouting Operation Diagram

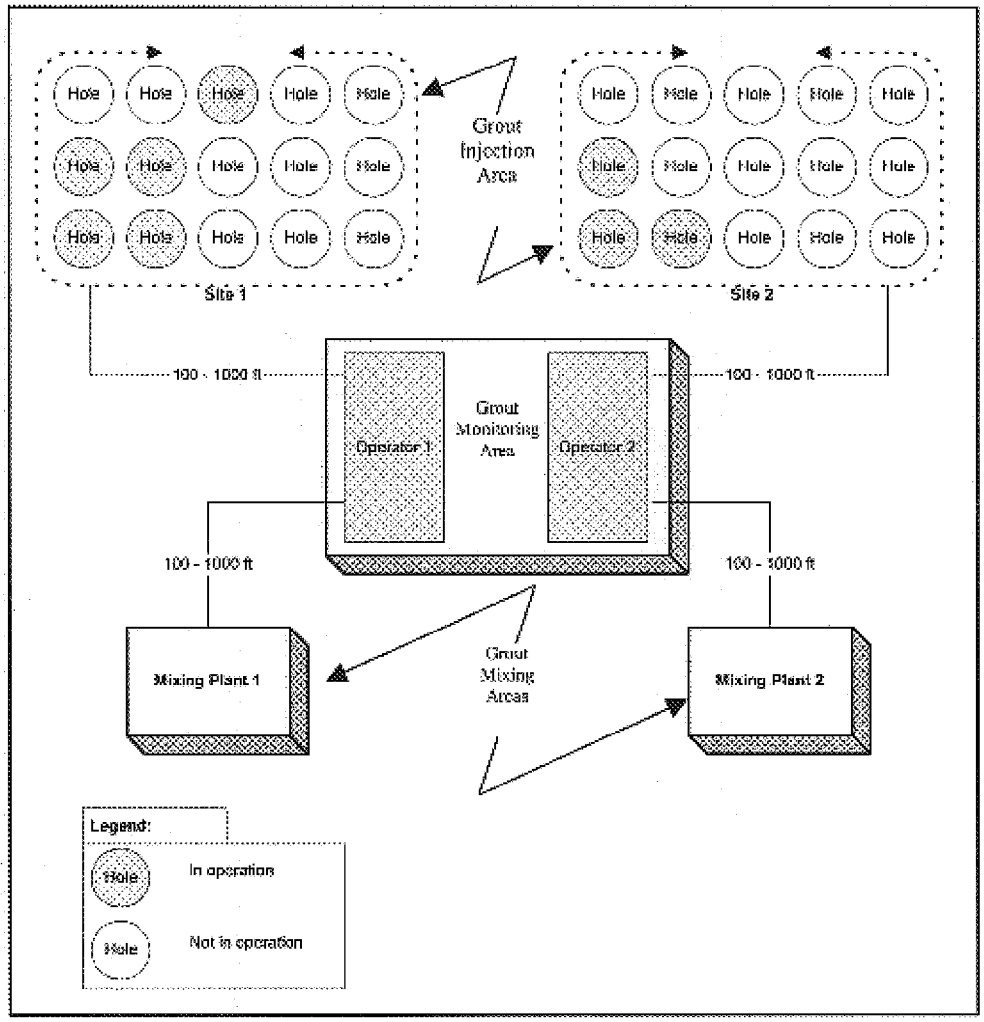
Figure 1: Grouting Operation Diagram

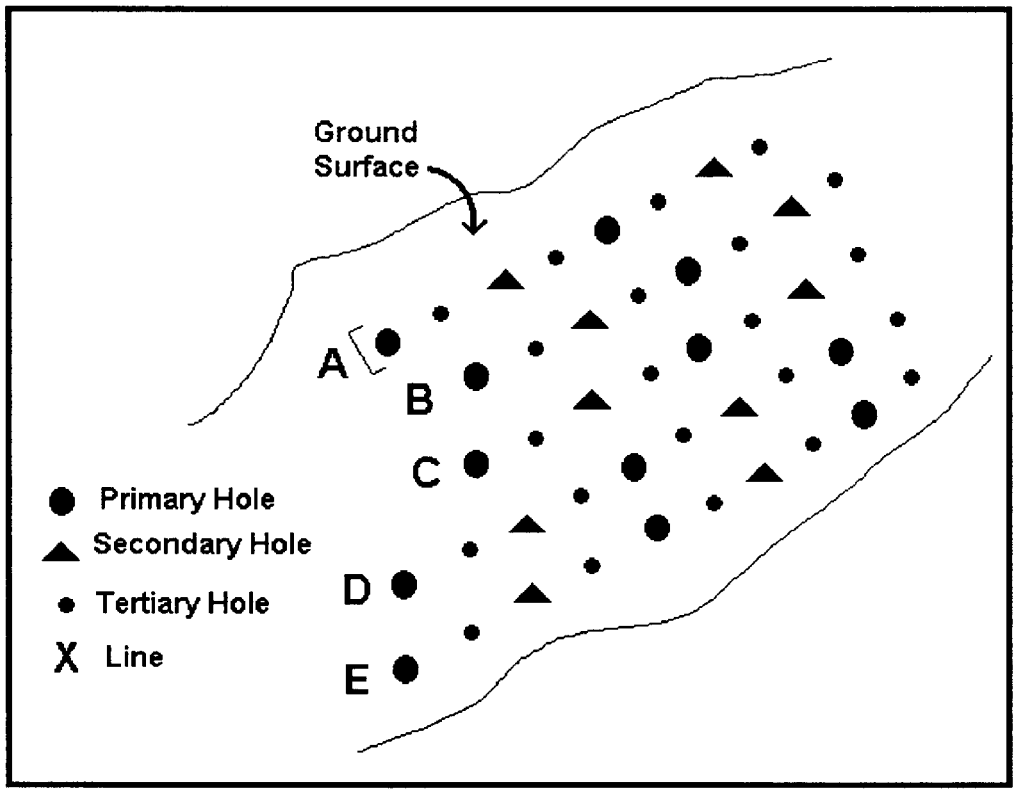
Figure 2: Line, Hole, Series Aerial View

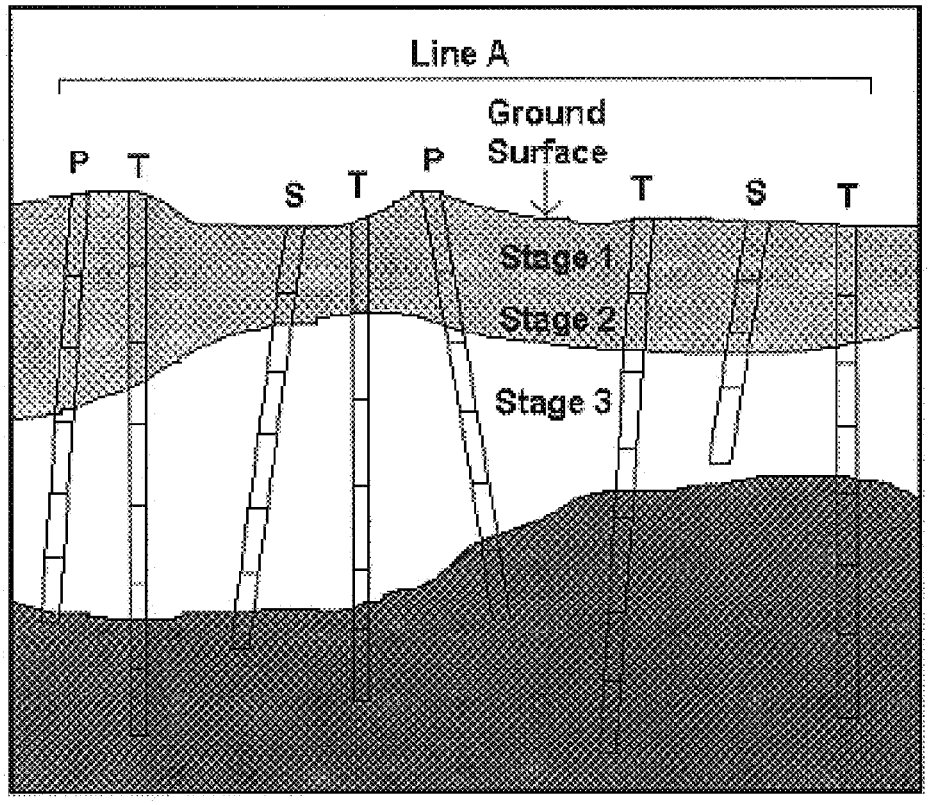
Figure 3: Line, Hole, Series, Stage Cross-section View

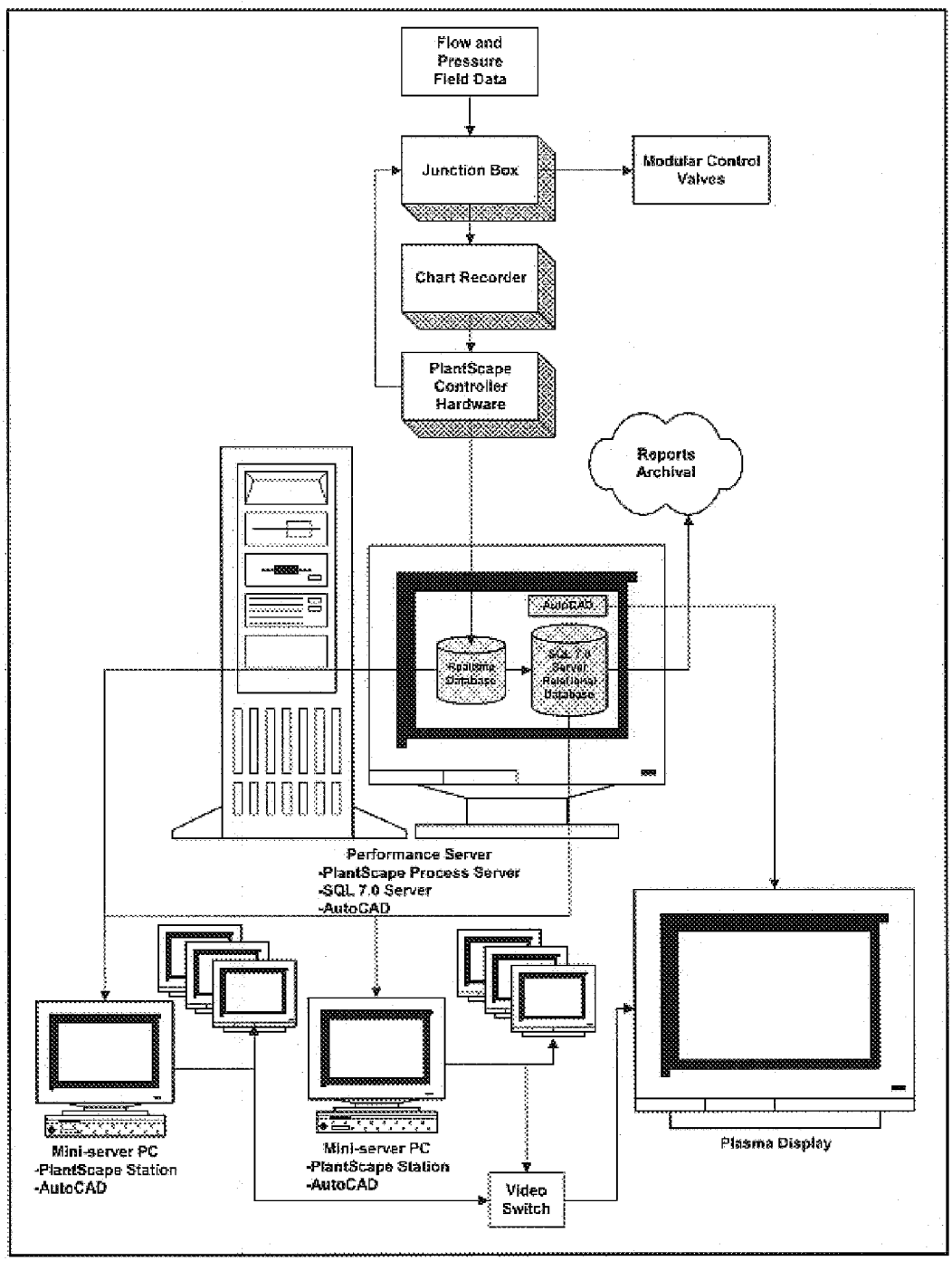
Figure 4: System block diagram

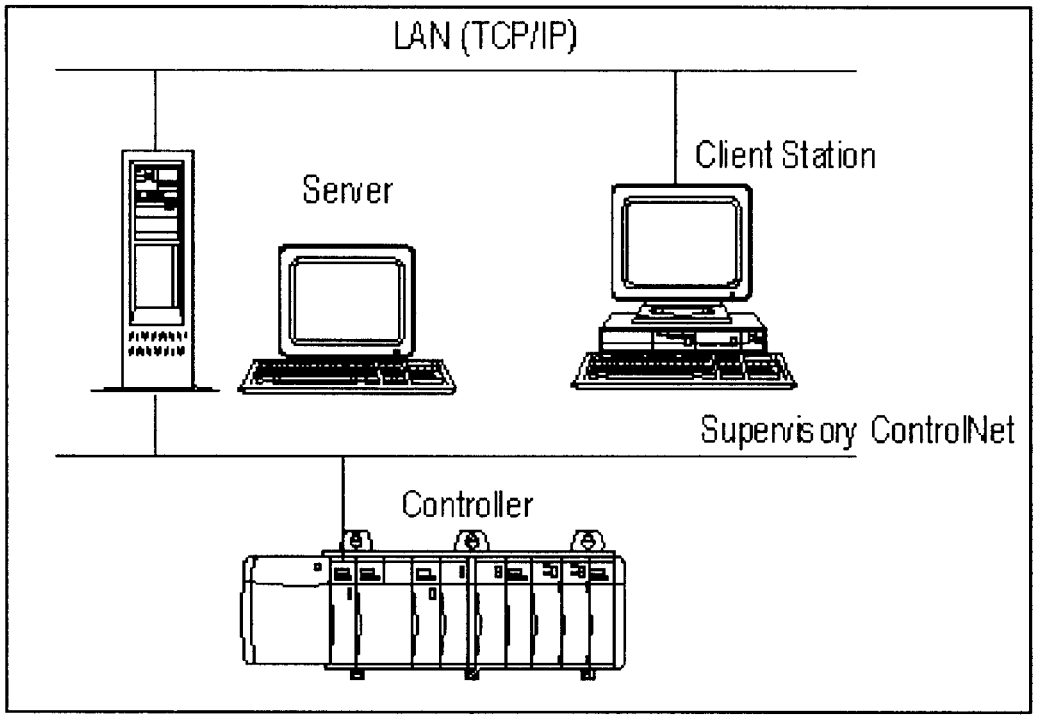
Figure 5: PlantScape® Architecture

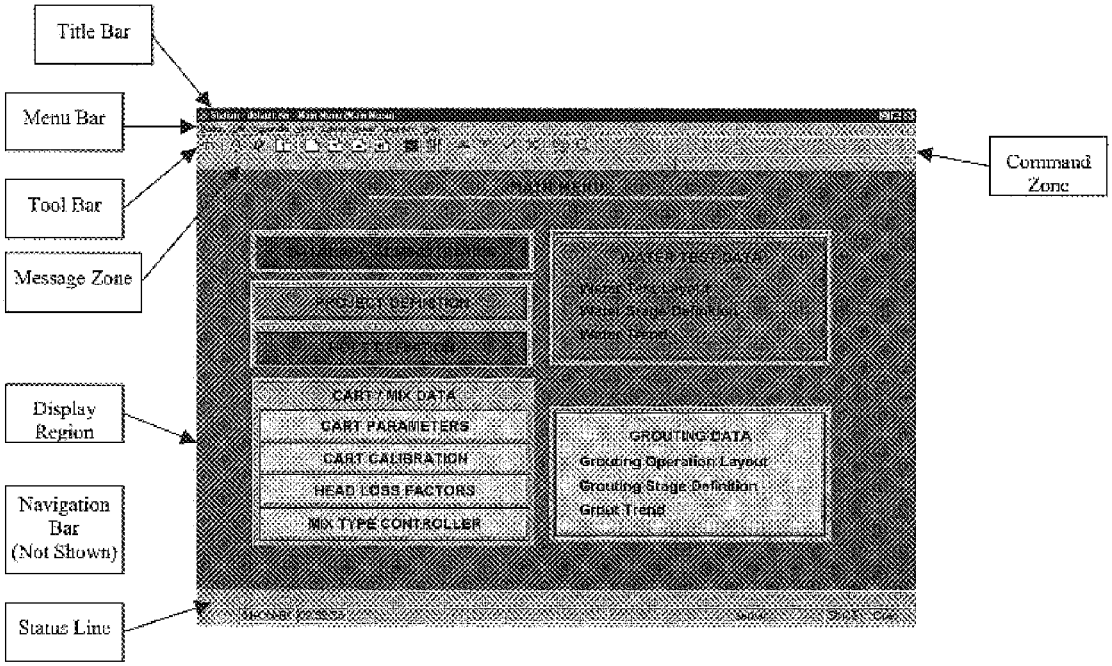
Figure 6: PlantScape® station window

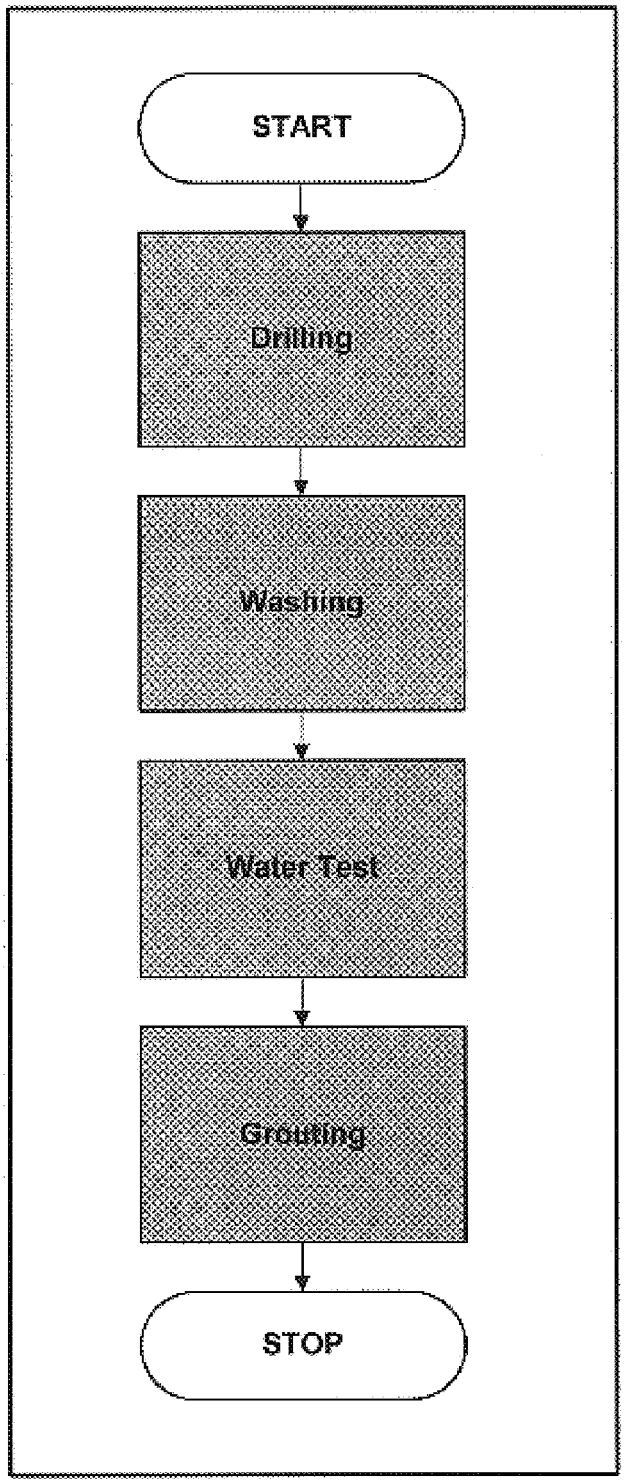
Figure 7: Operation Sub-Processes

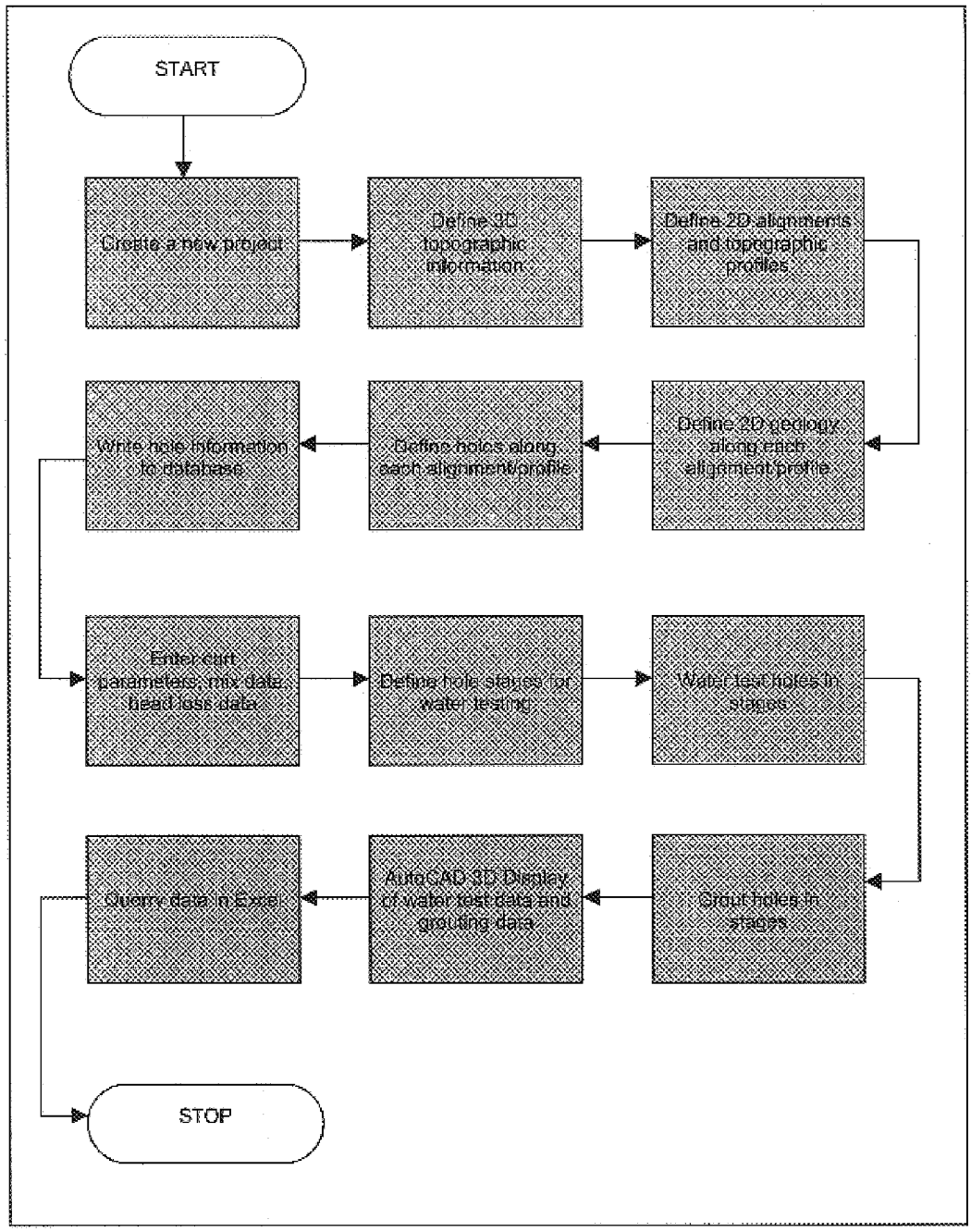
Figure 8: Sequence of Operations

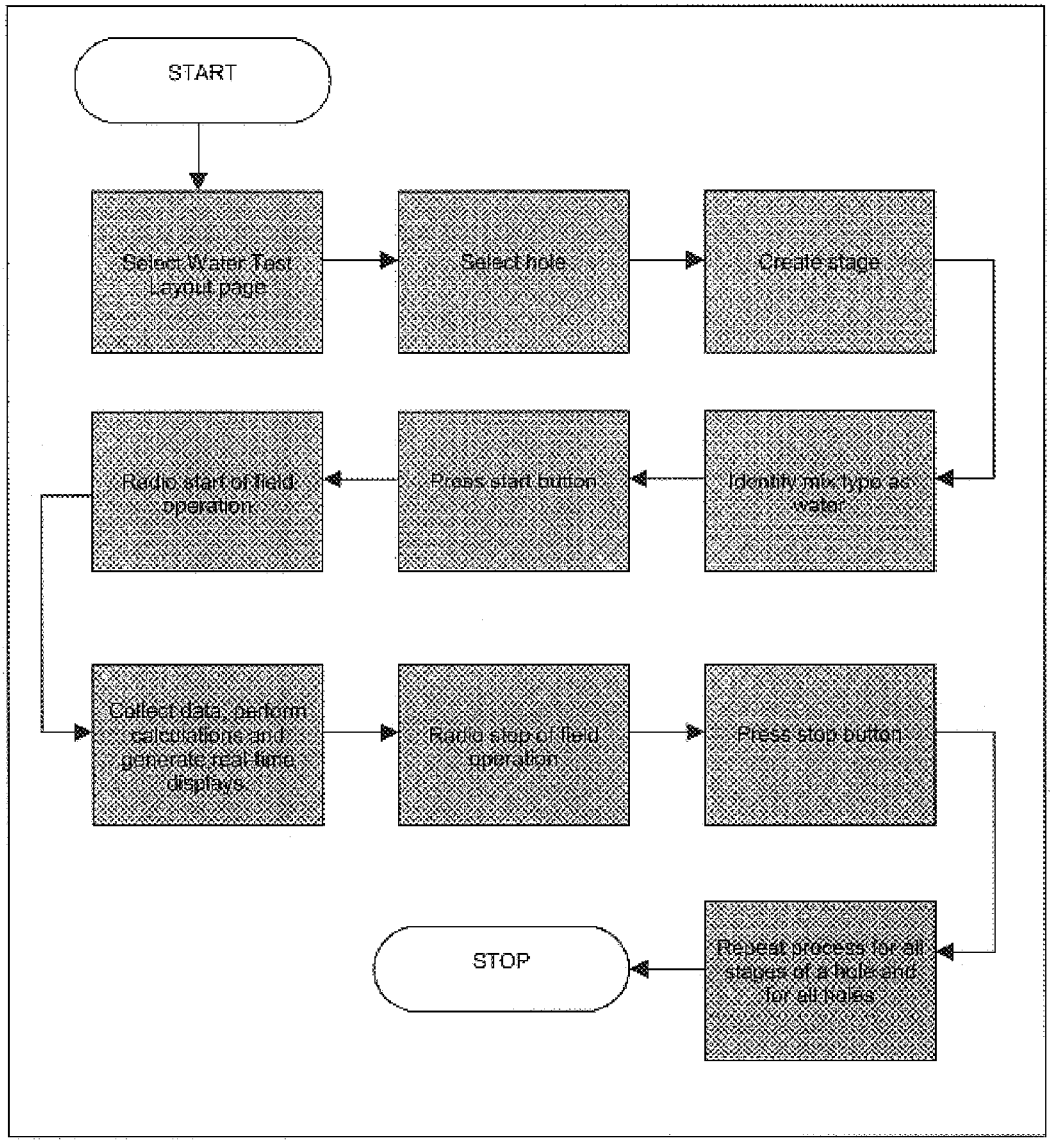
Figure 9: Sequence of Water Test Operation

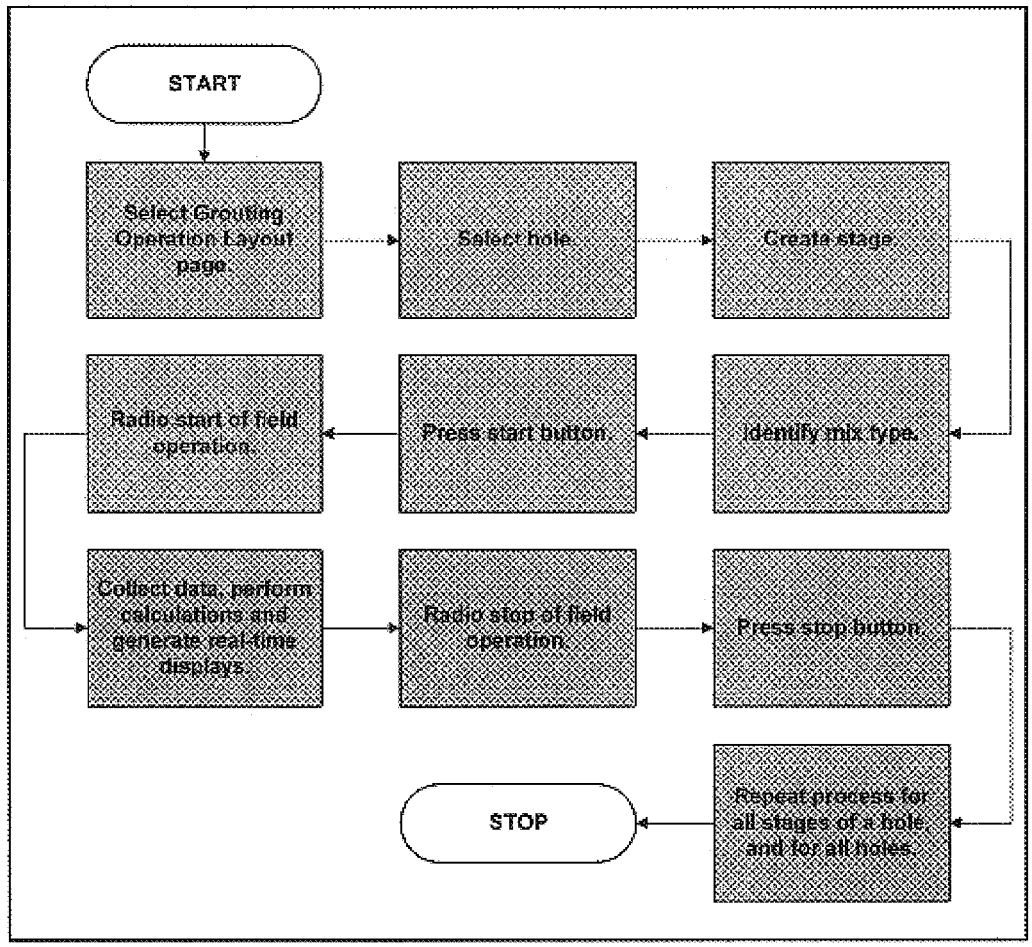
Figure 10: Sequence of Grouting Operation

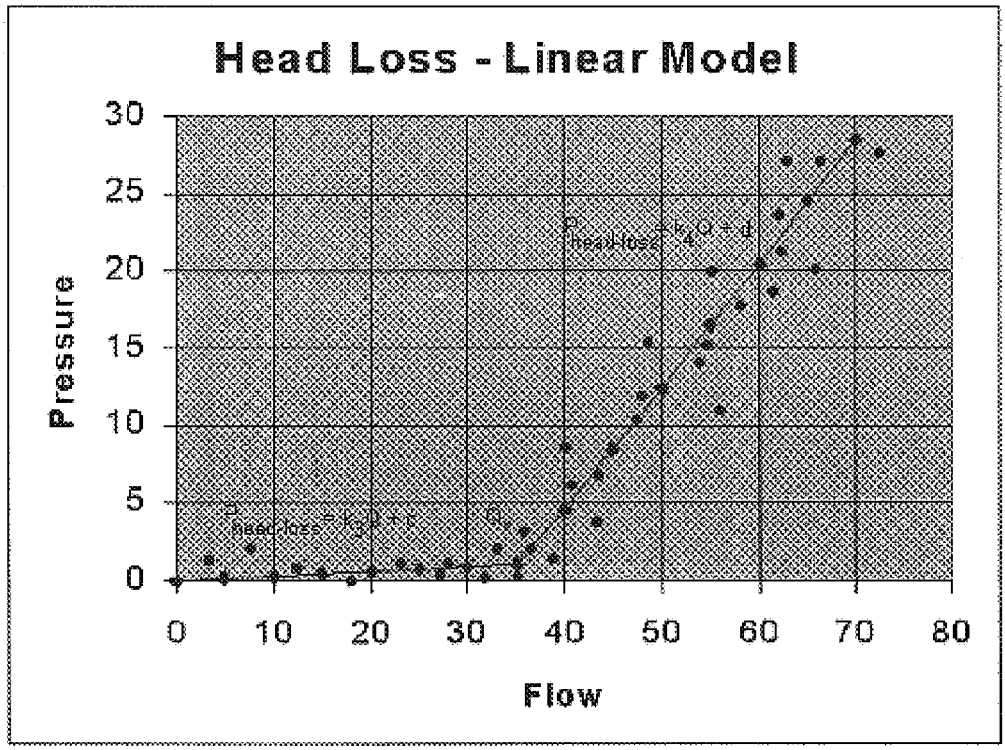
Figure 11: Head Loss – Linear Model

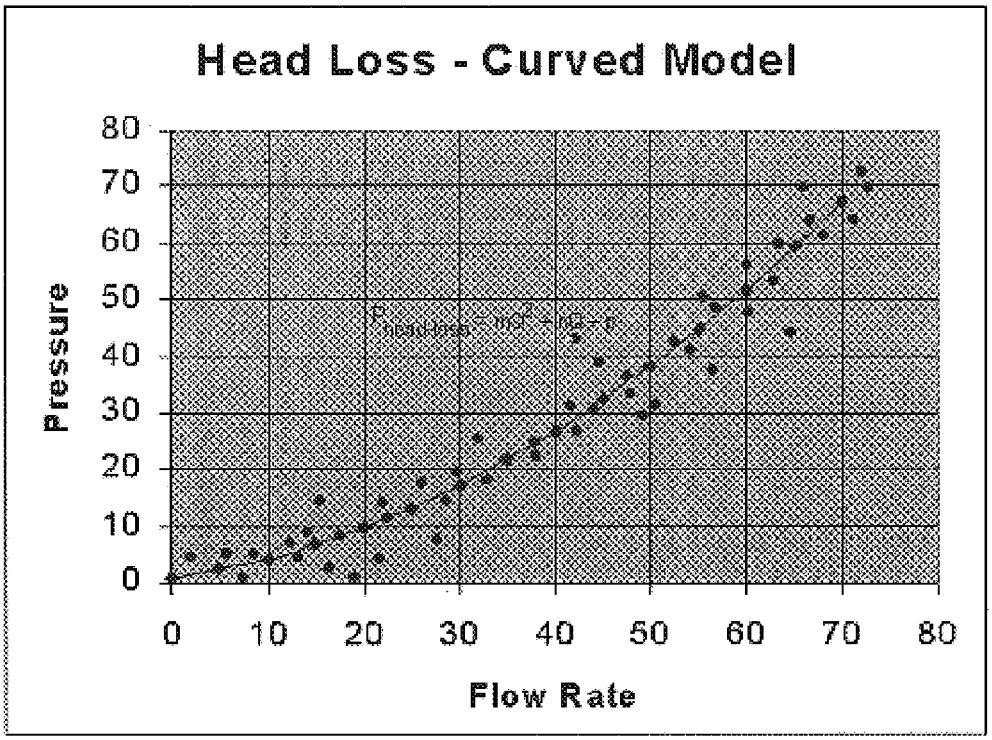
Figure 12: Head Loss – Curved Model

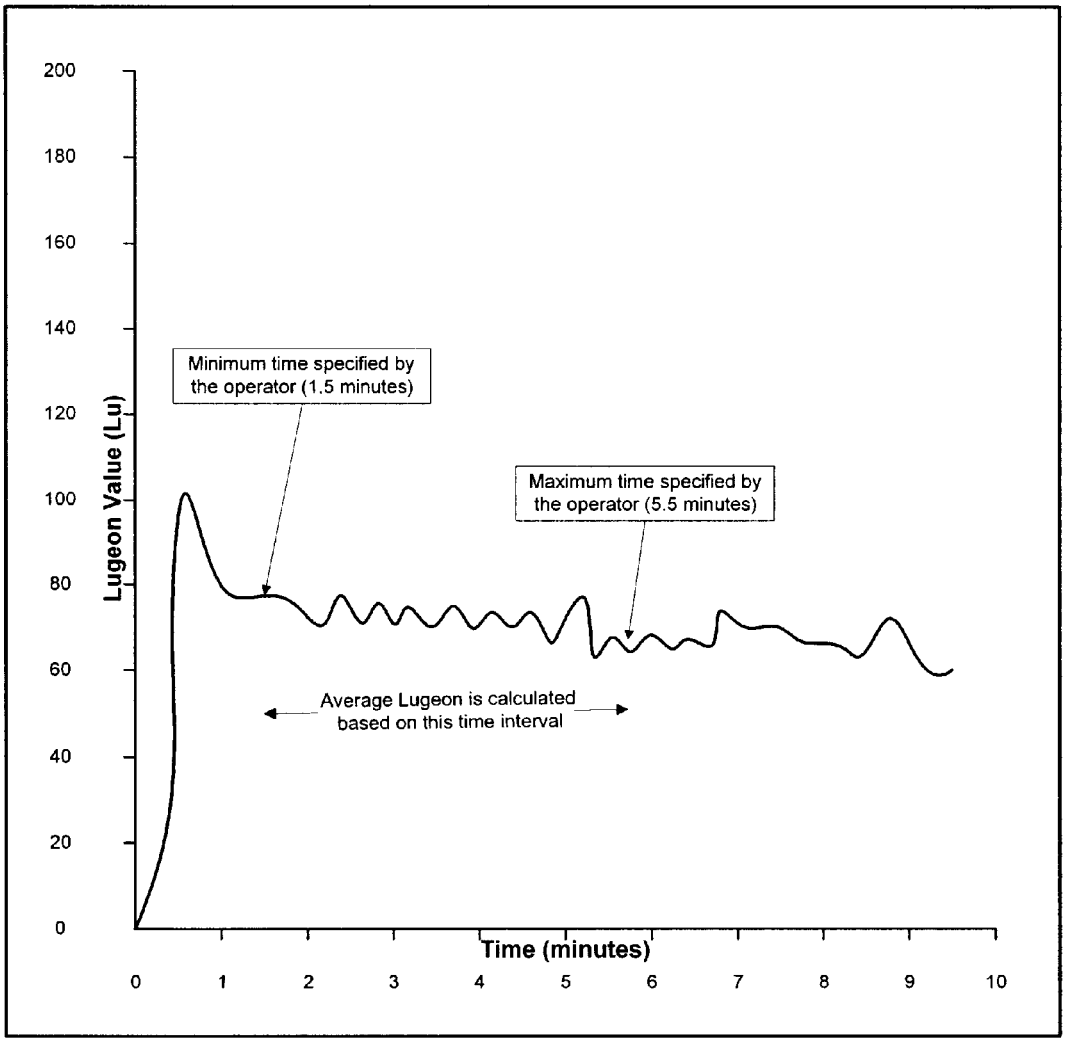
Figure 13: Average Lugeon Calculation

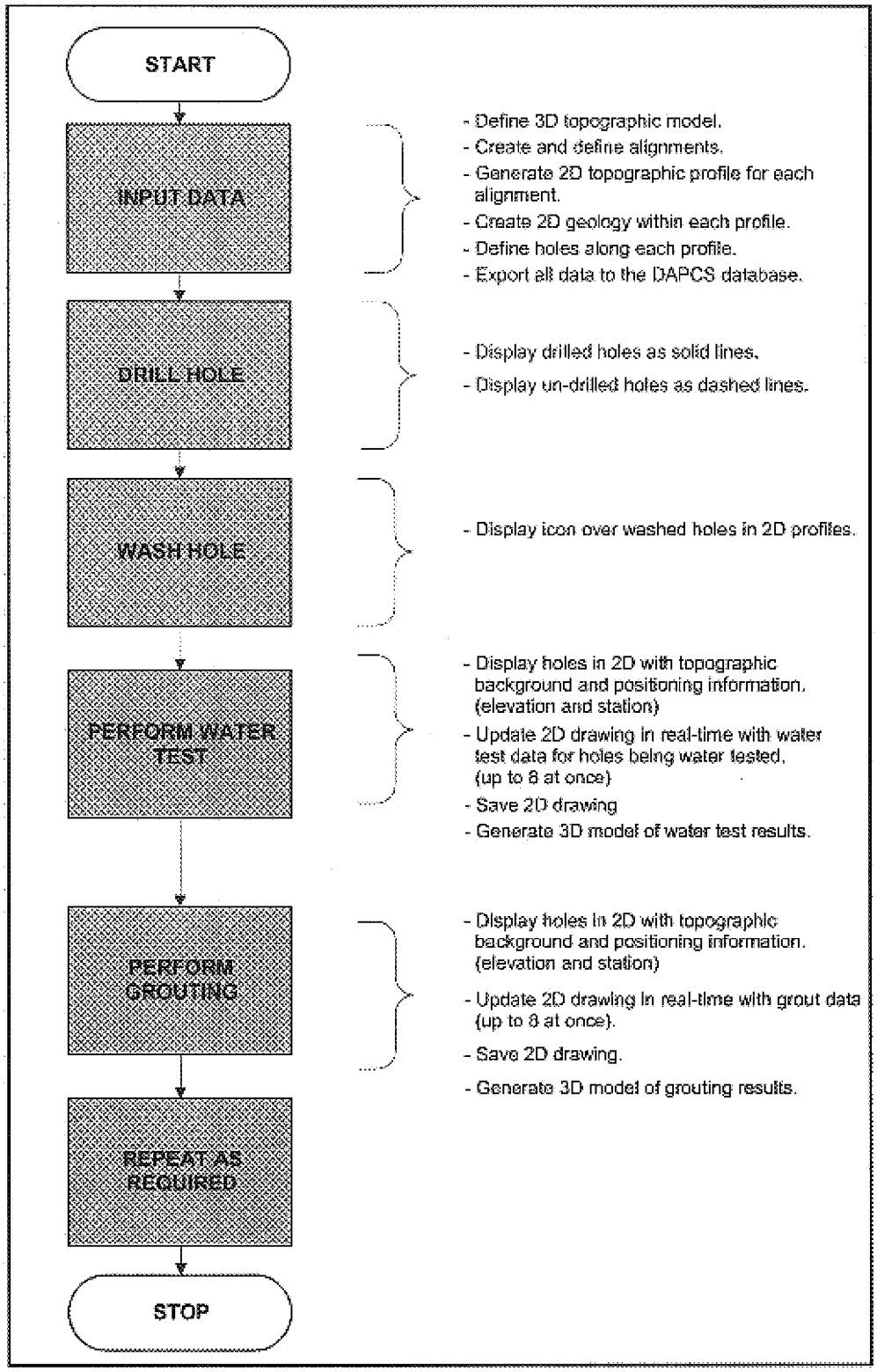
Figure 14: AutoCAD System FlowChart

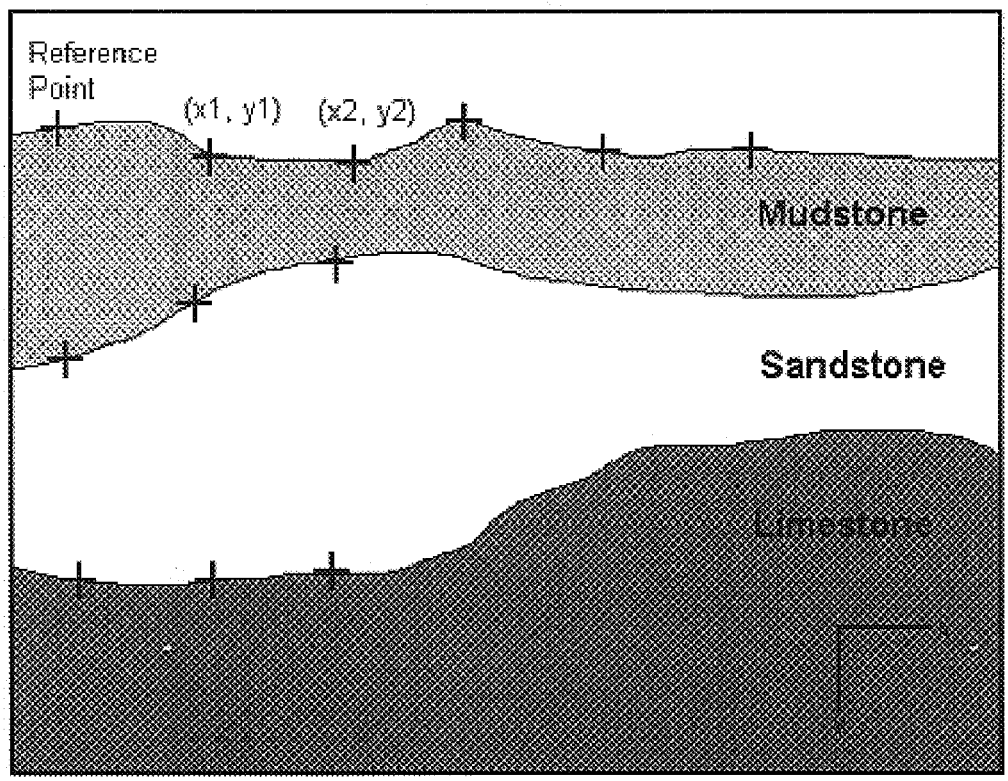
Figure 15: Geologic Model

```
geology=limestone
color=6
50.3     513.53
200.34   542.55
453.43   550.44
602.4    556.32
803.45   579.93
858.45   575.34
943.56   563.45
1125.51  527.42
geology=sandstone
color=2
50.3     523.51
223.45   551.67
453.43   568.41
602.4    576.32
803.45   594.92
923.45   586.34
1023.56  560.03
1103.56  534.56
geology=rock
color=3
50.3     533.5
234.45   565.34
453.43   583.43
602.4    596.32
803.45   614.94
903.45   609.27
987.45   593.21
1105.52  547.42
```

Figure 16: AutoCAD Geology Input text file

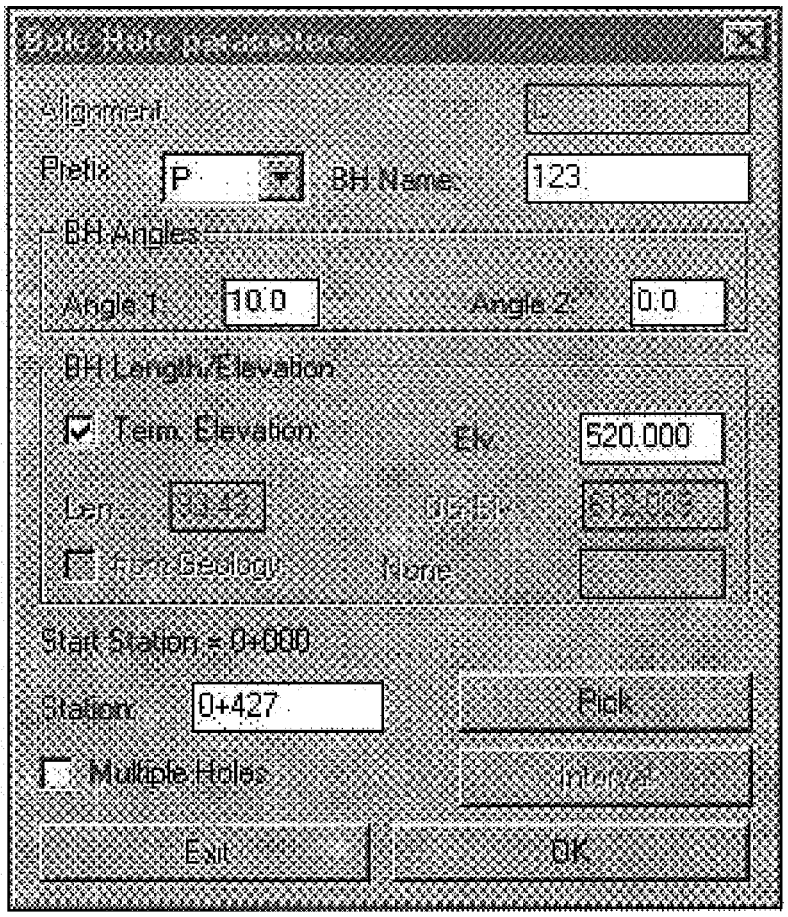
Figure 17: AutoCAD Hole Creation Menu

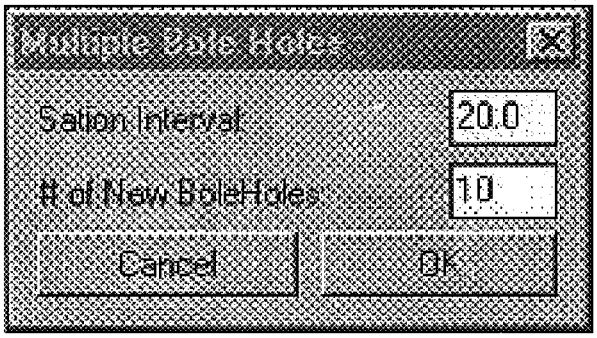
Figure 18: AutoCAD Multiple Hole Creation Menu

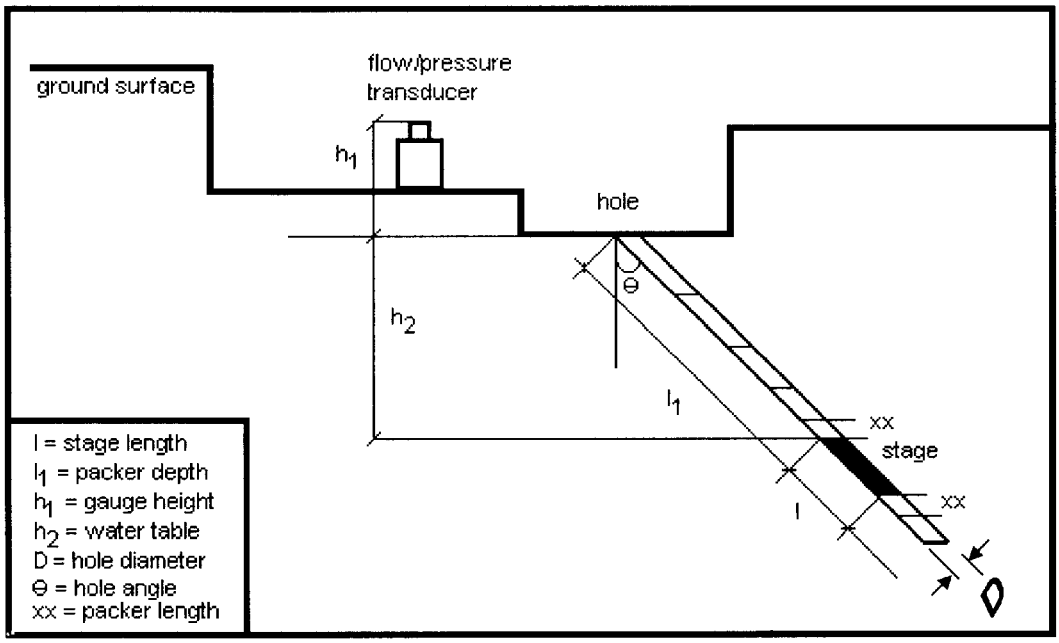
Figure 19: Hole Geometry

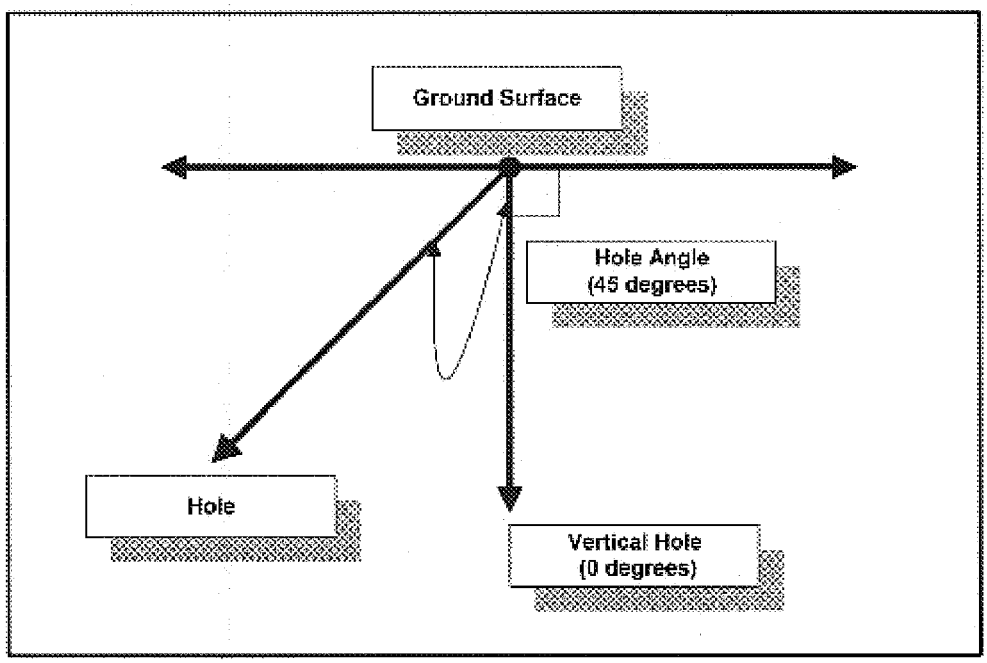
Figure 20: Hole Angle

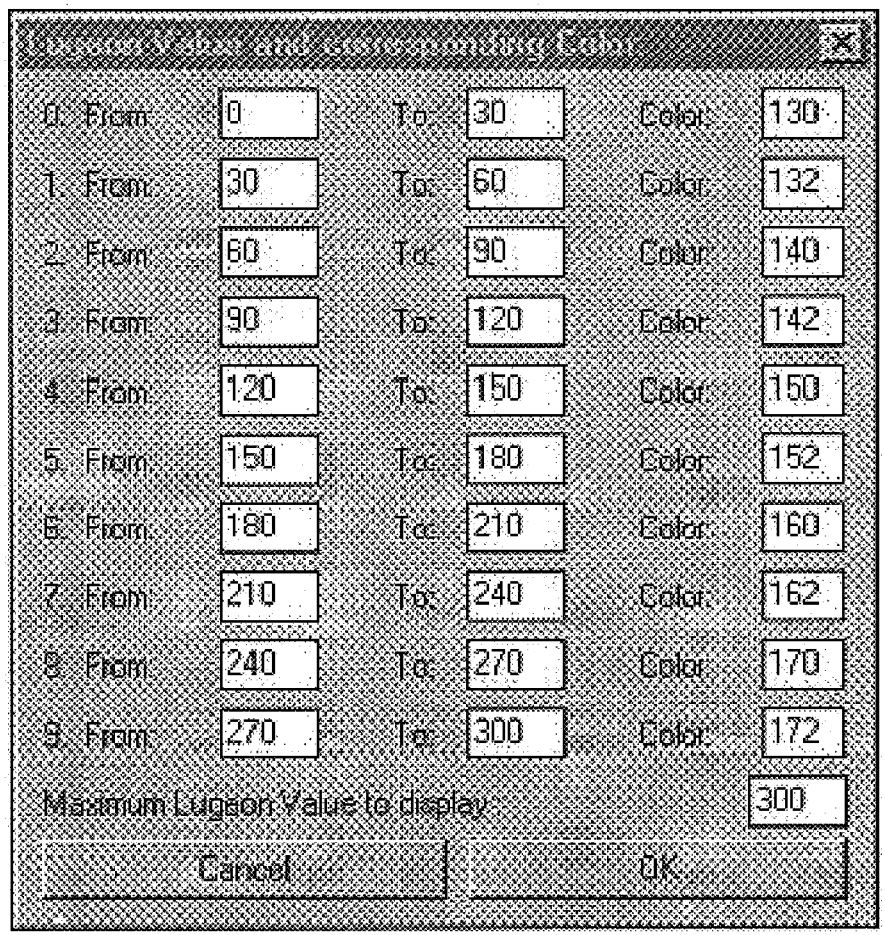
Figure 21: AutoCAD Lugeon Color Menu

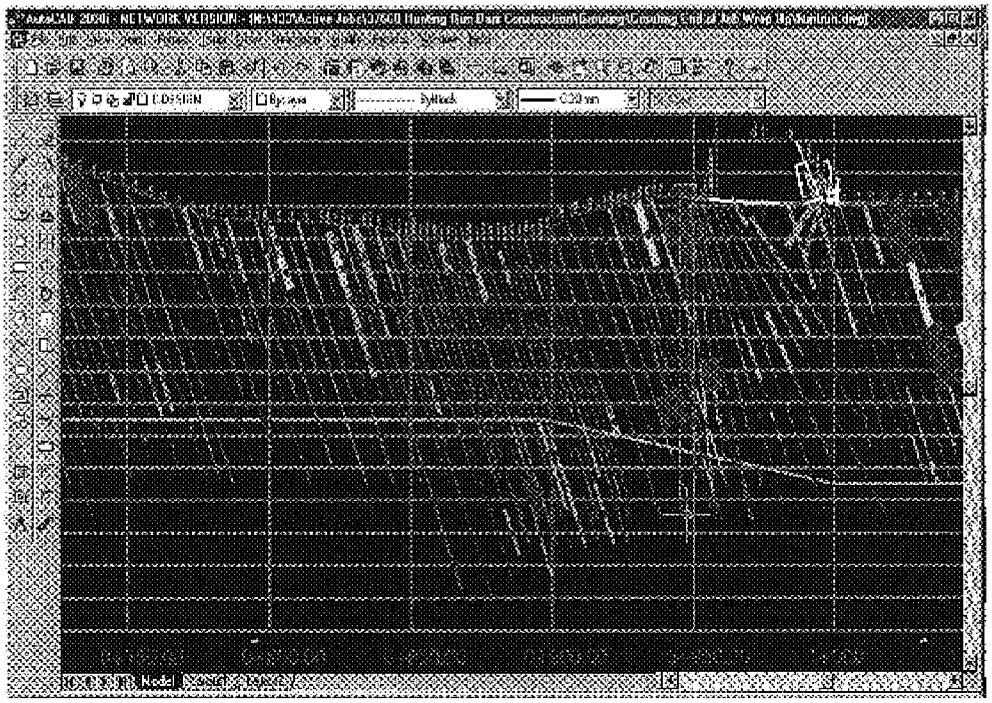
Figure 22: Sample AutoCAD 2D Water Test Display
w/ Lugeon value color coding

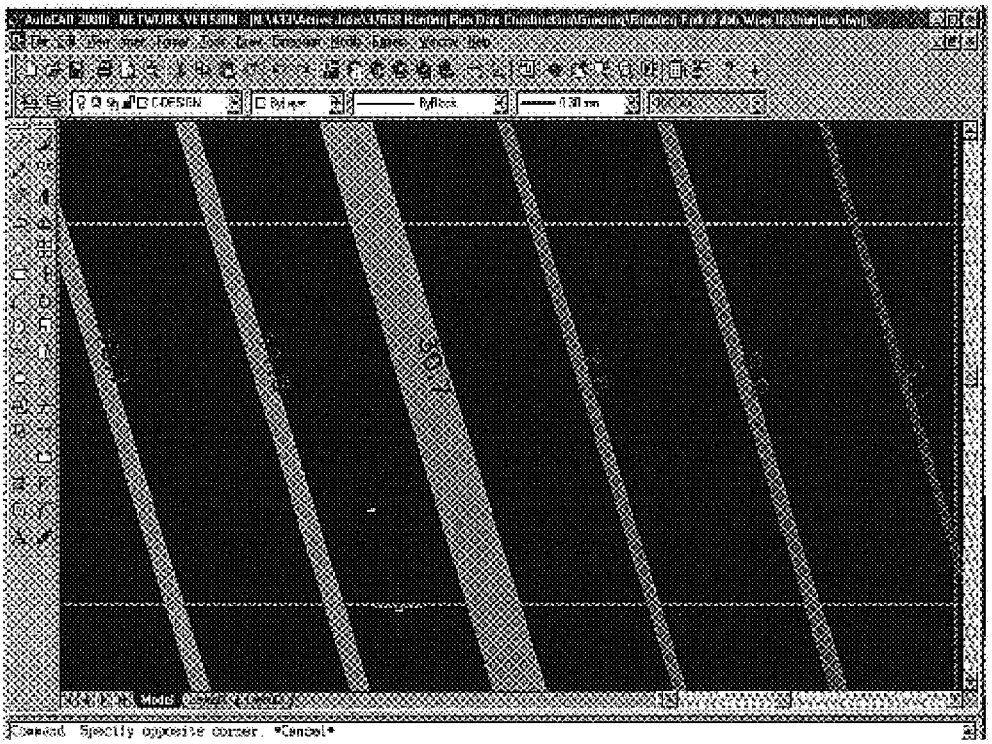
Figure 23: Sample AutoCAD 2D Water Test Display
w/ Lugeon values and color coding

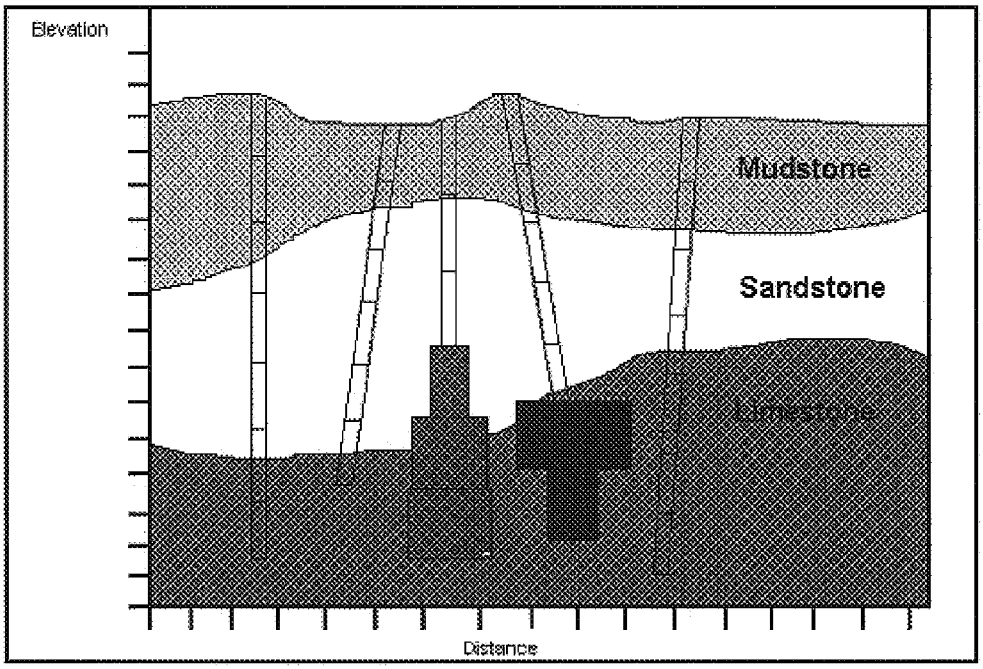
Figure 24: Sample AutoCAD 2D Grouting Operations Display
w/ radius of grout spread

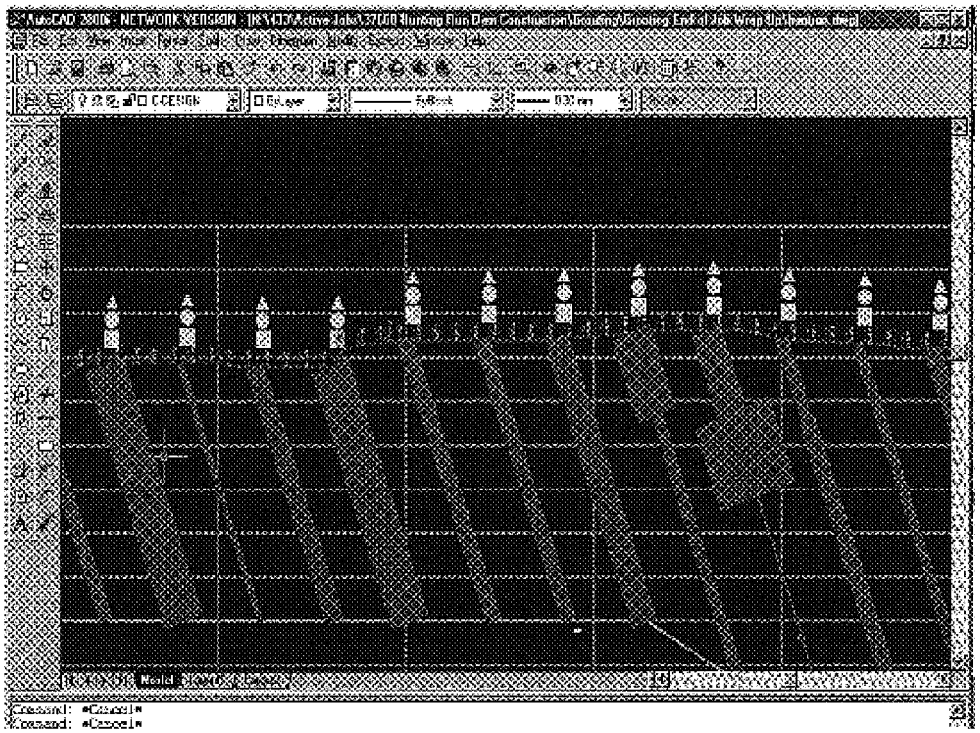
Figure 25: AutoCAD 2D Grouting Operation Display
w/radius of grout spread and grout volumes

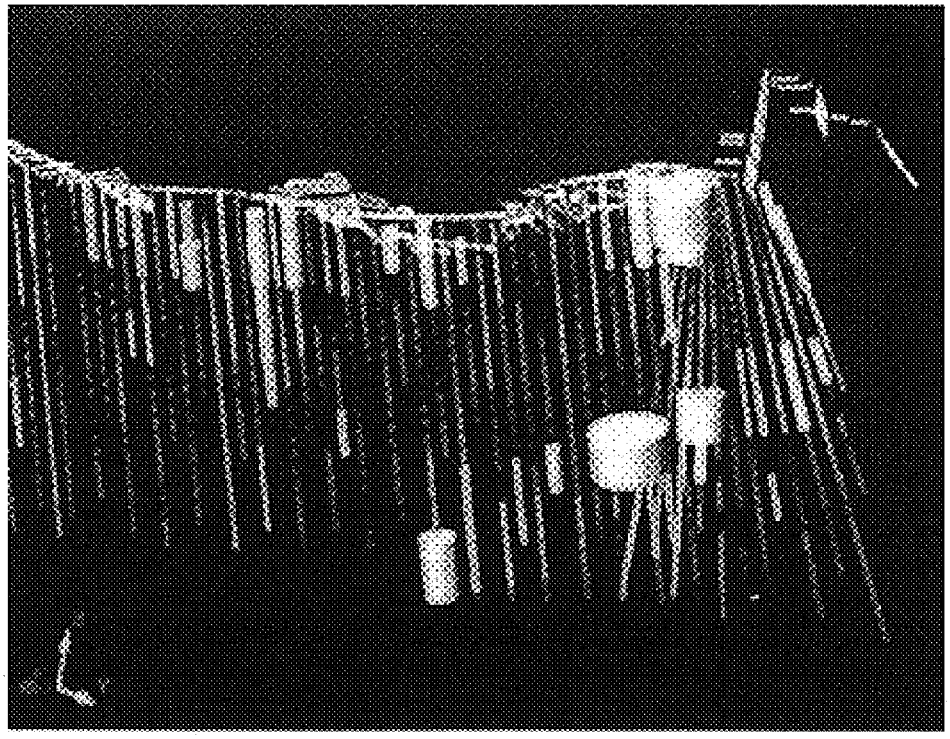
Figure 26: AutoCAD 3D Water Testing Operation Display
w/Lugeon value displayed as cylinder

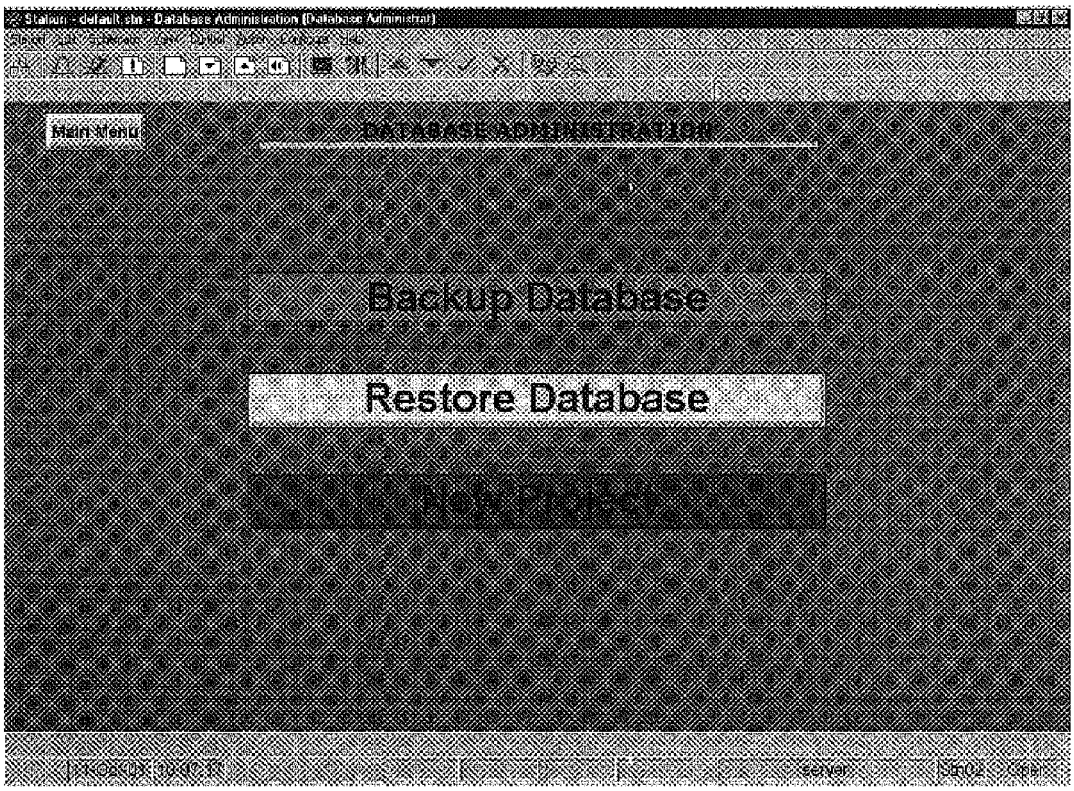
Figure 27: Database Administration Display/Input Subsystem screen

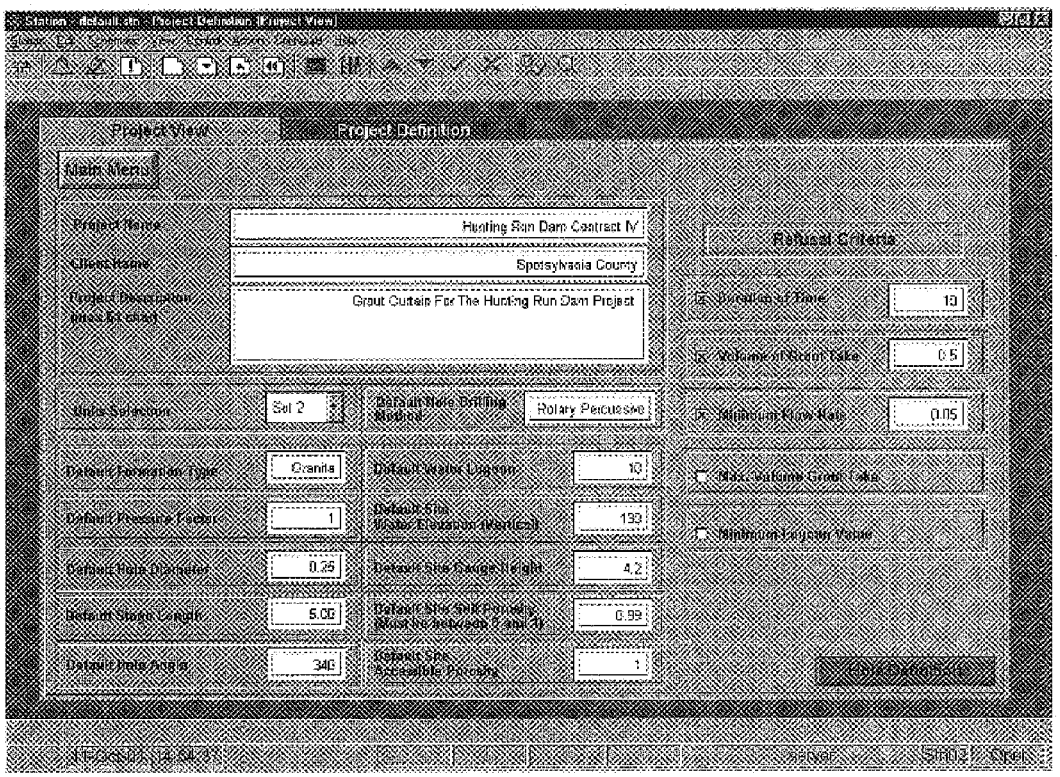
Figure 28: Project Definition Display/Input Subsystem screen

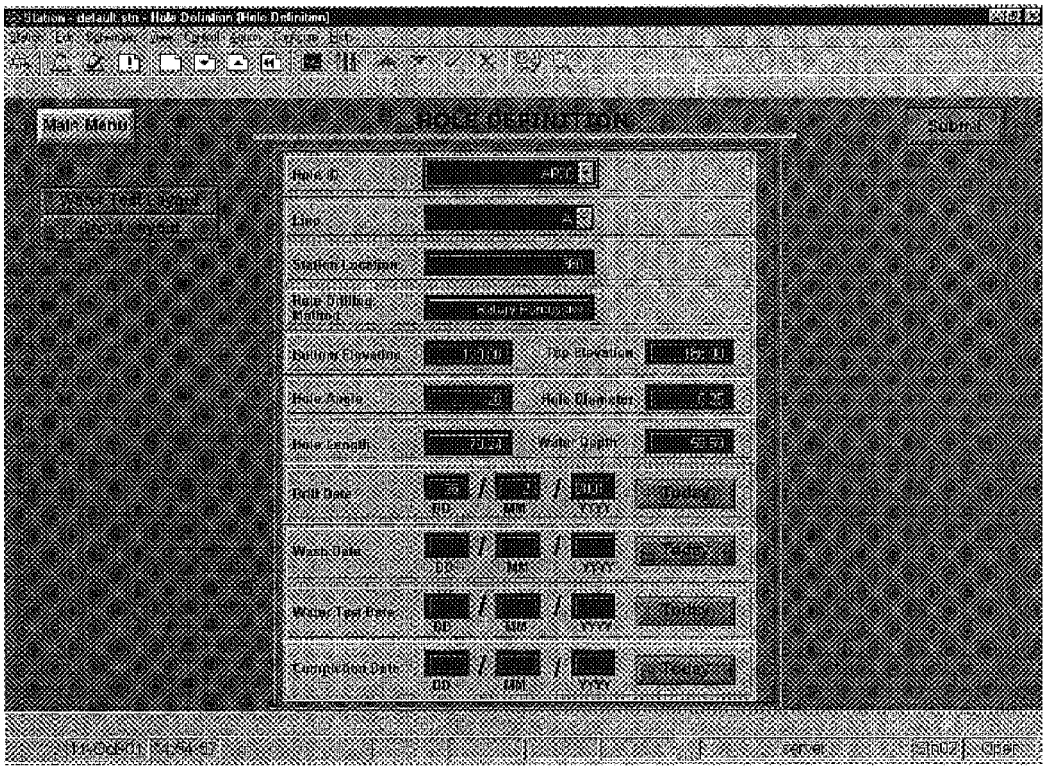
Figure 29: Hole Definition Display/Input Subsystem screen

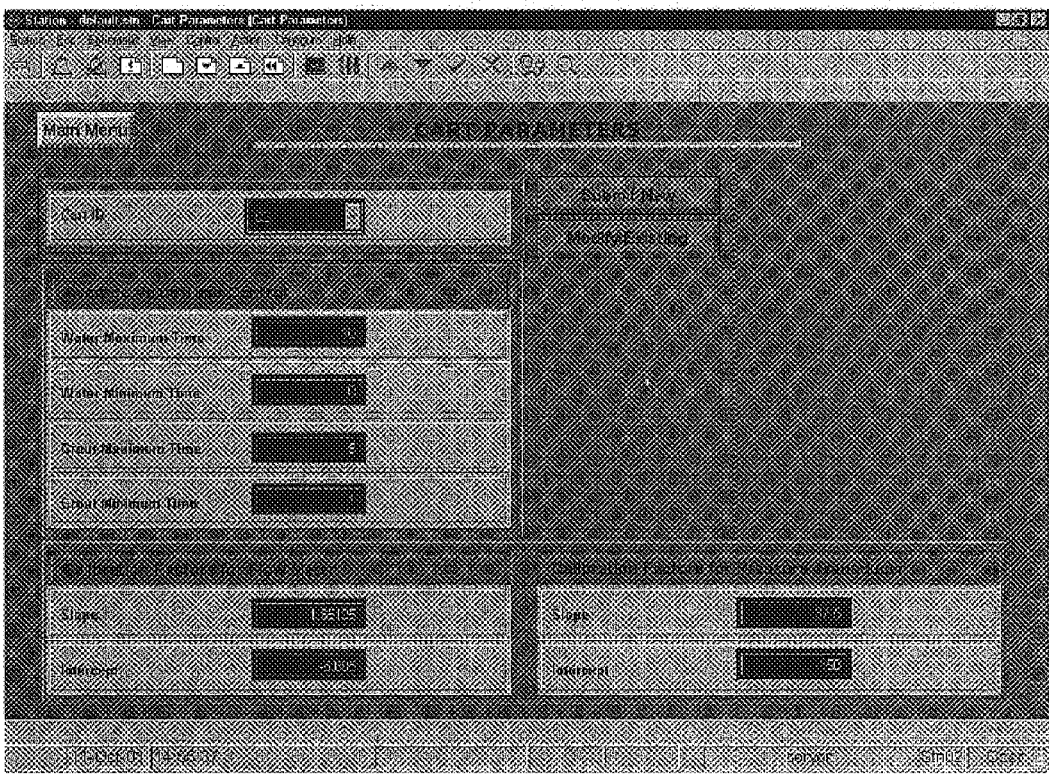
Figure 30: Cart Parameters Display/Input Subsystem screen

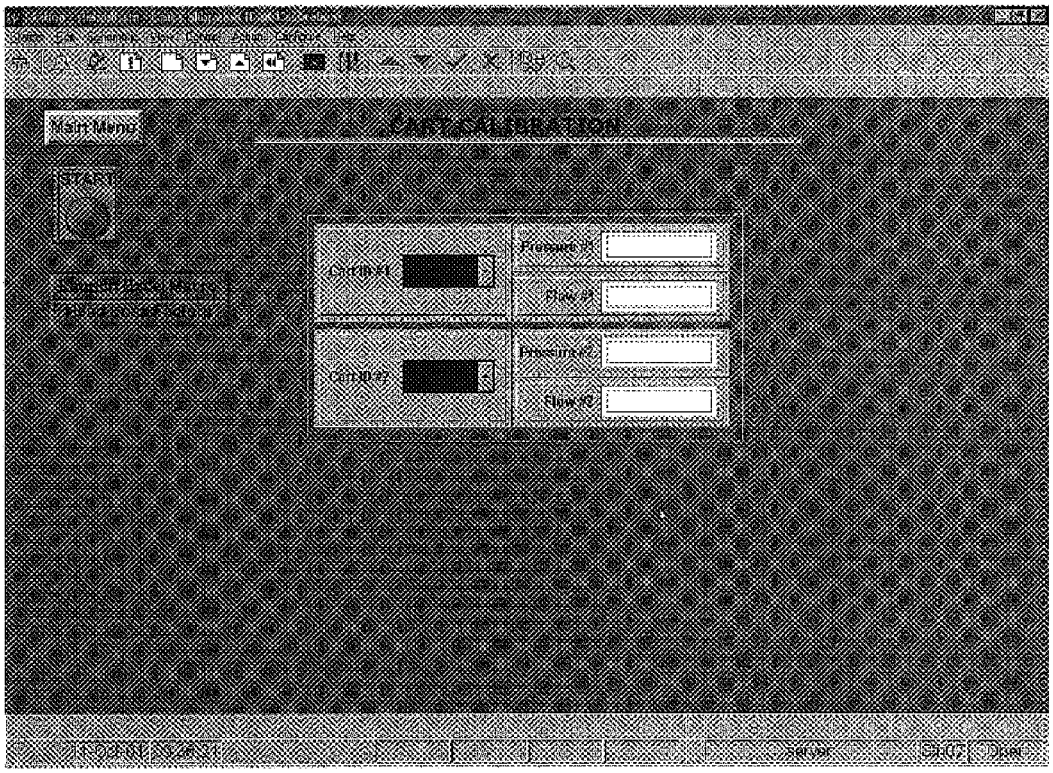
Figure 31: Cart Calibration Display/Input Subsystem screen

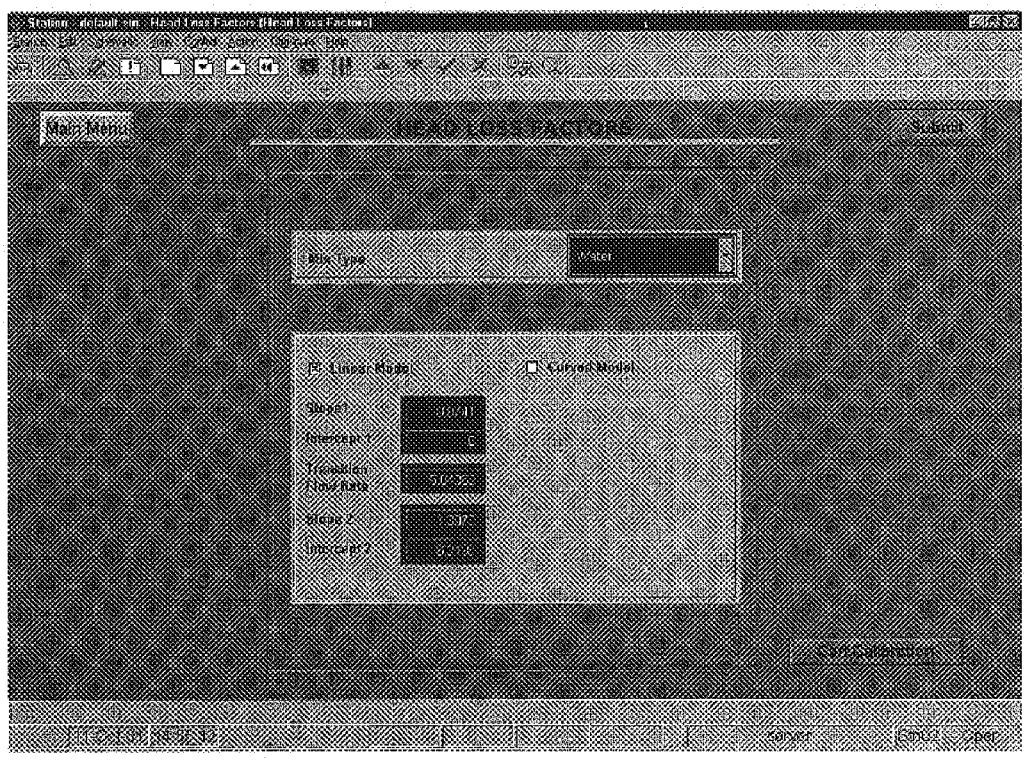
Figure 32: Grouting Data Display/Input Subsystem screen

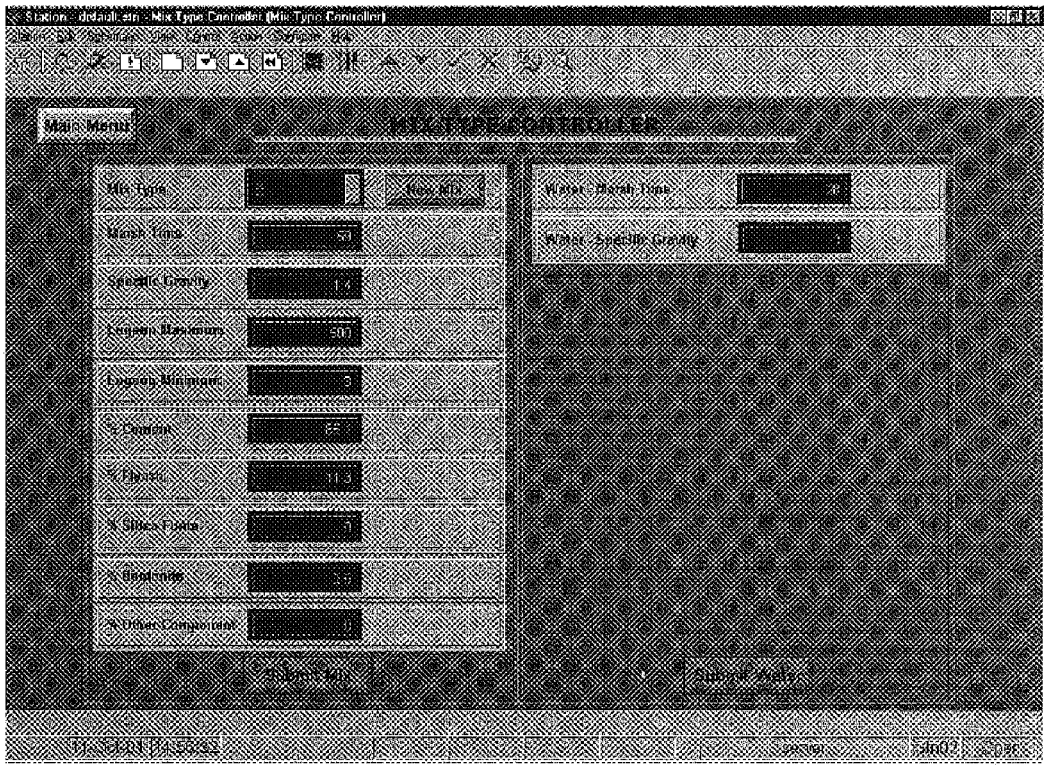
Figure 33: Mix Type Display/Input Subsystem screen

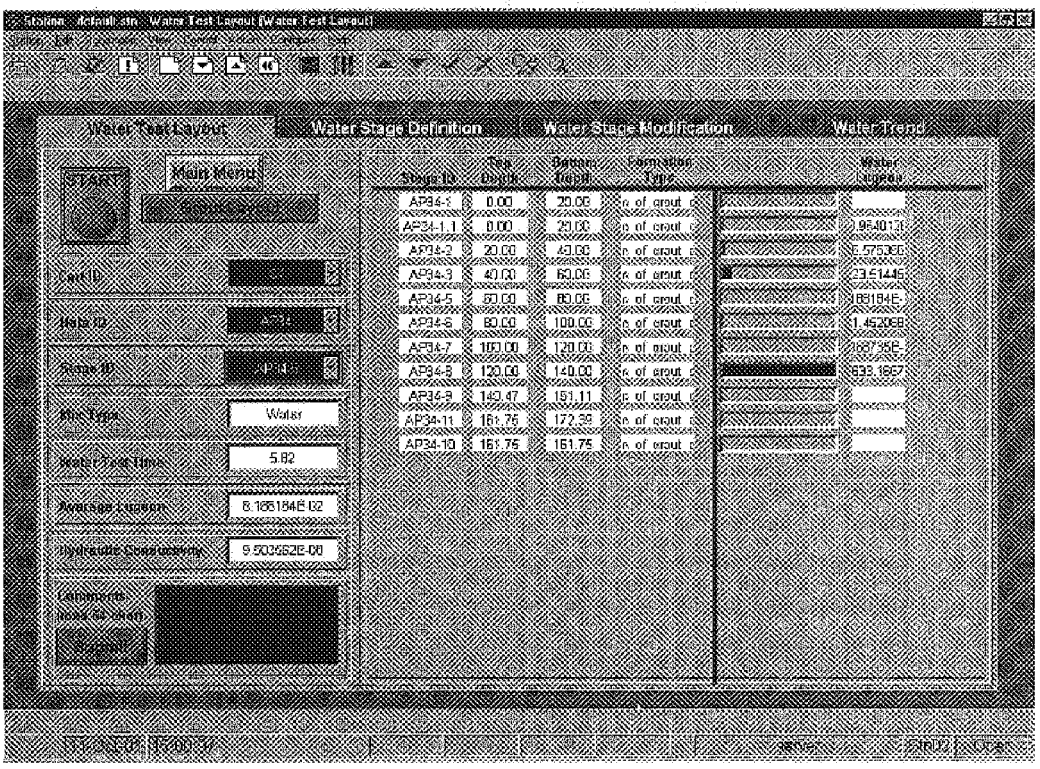
Figure 34: Water Test Data Display/Input Subsystem -- Layout screen

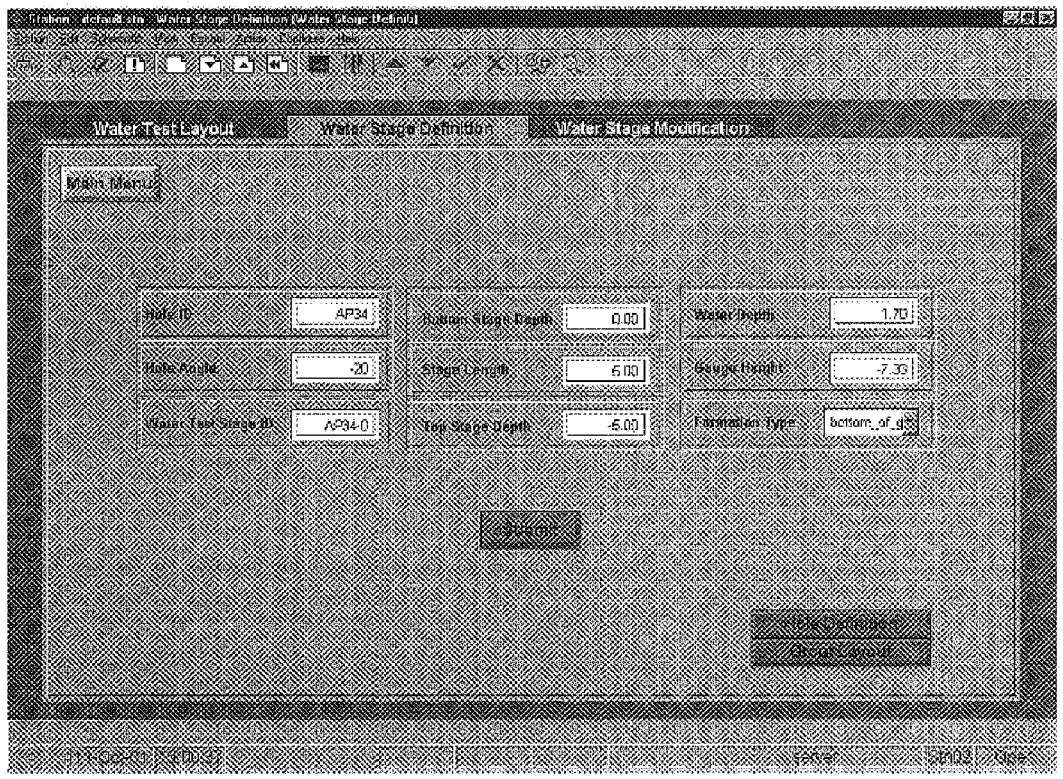
Figure 35: Water Test Data Display/Input Subsystem -- Stage Definition screen

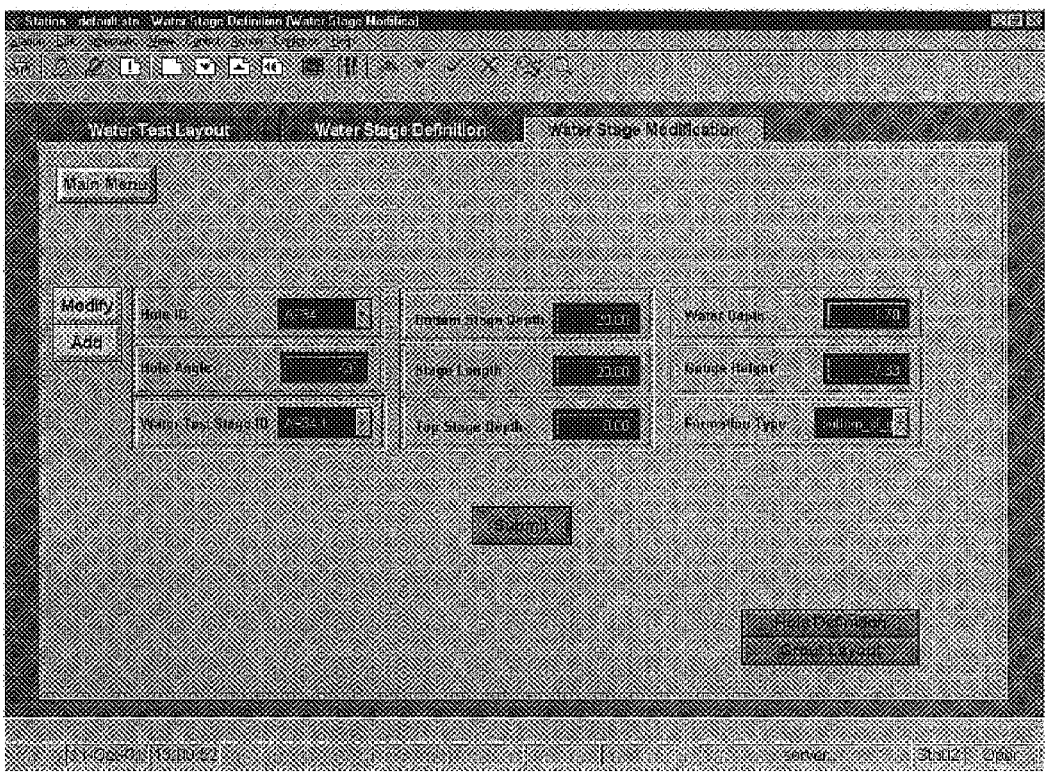
Figure 36: Water Test Data Display/Input Subsystem – Stage Modification screen

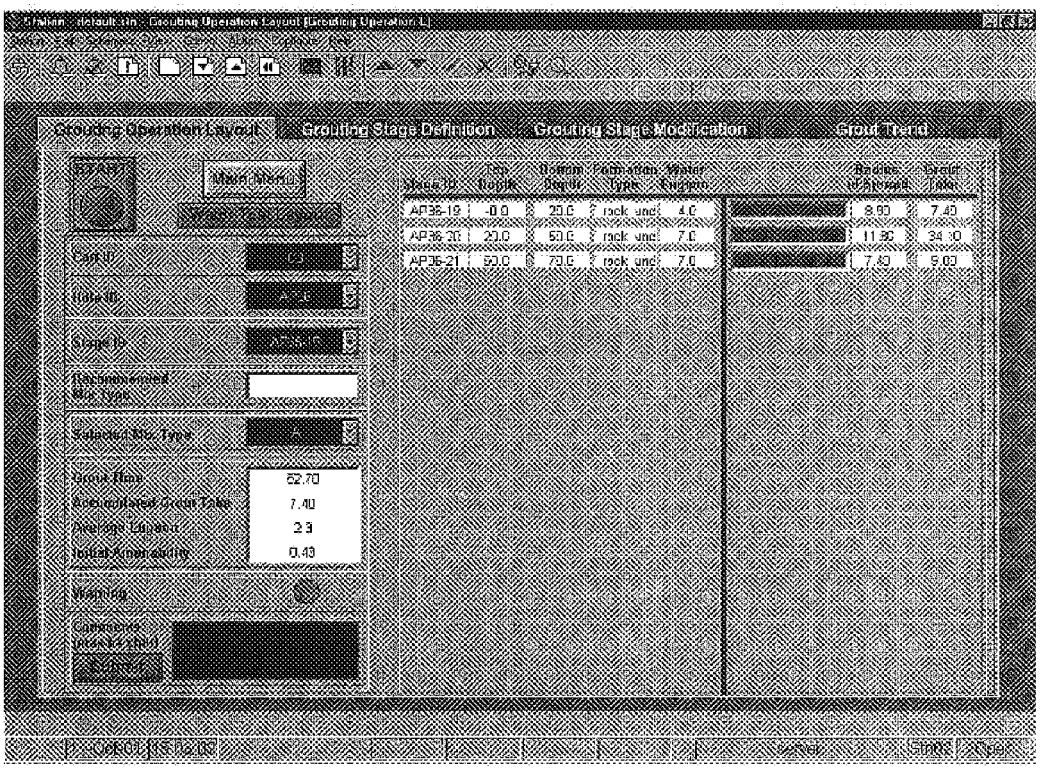
Figure 37: Grouting Data Display/Input Subsystem – Layout screen

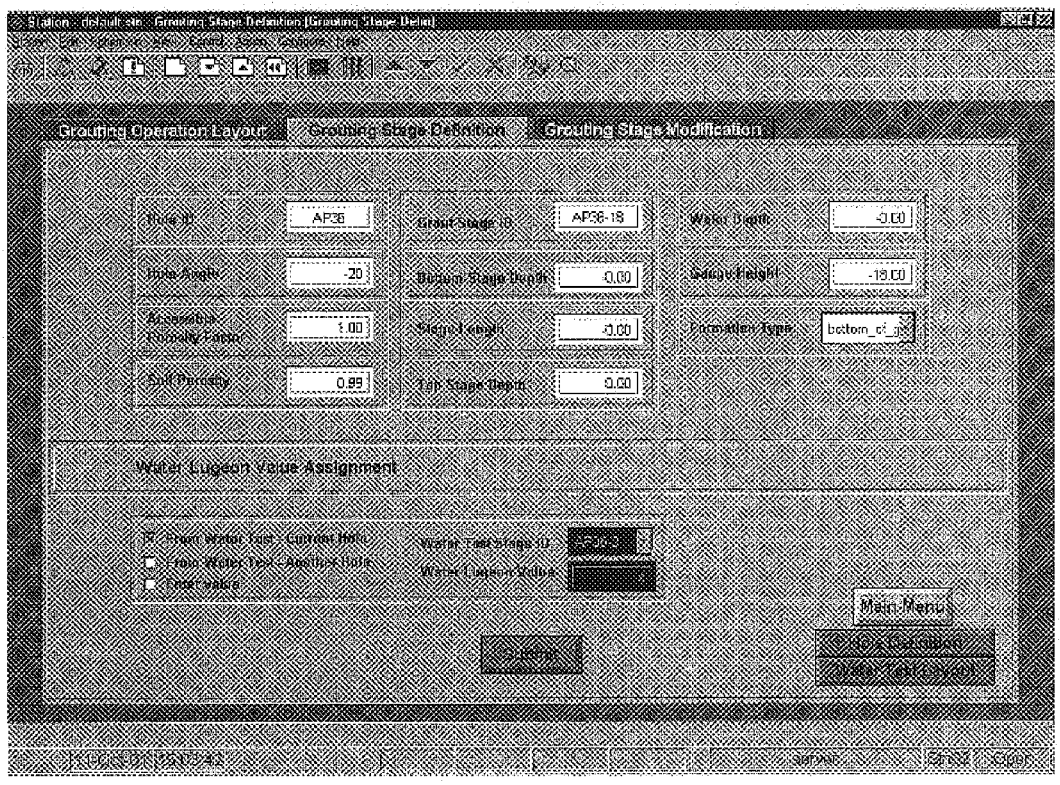
Figure 38: Grouting Data Display/Input Subsystem – Stage Definition screen

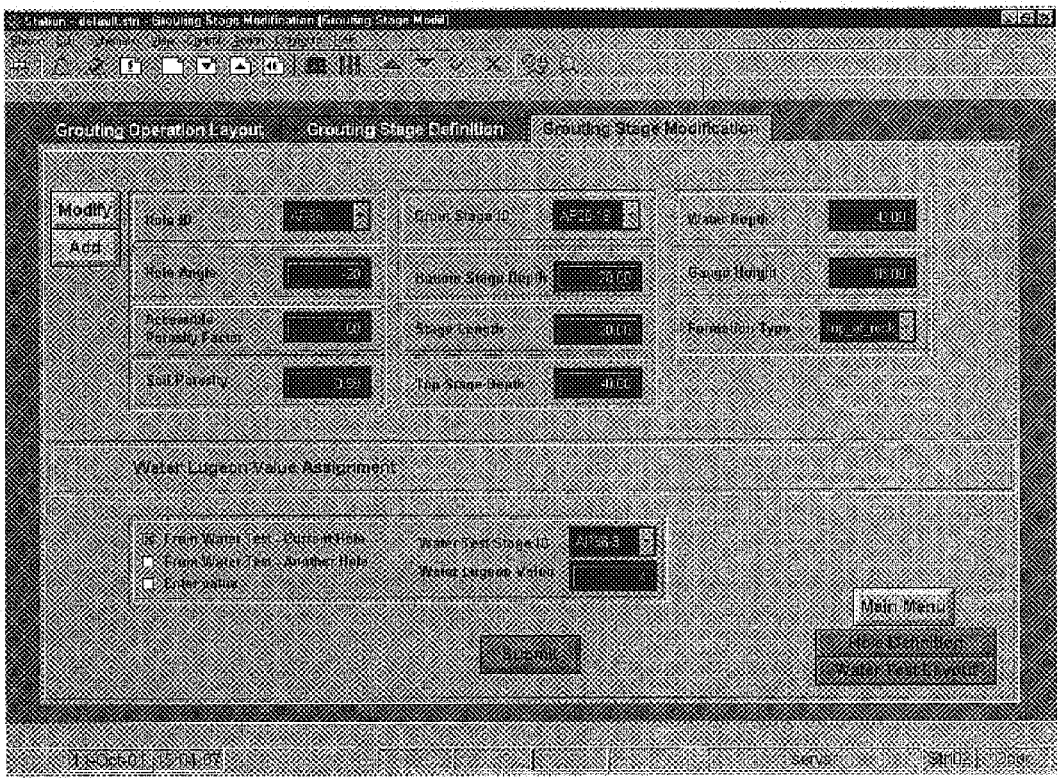
Figure 39: Grouting Data Display/Input Subsystem – Stage Modification screen

APPARATUS AND METHOD FOR COMPUTERIZED DATA COLLECTION, MONITORING, ANALYSIS, AND CONTROL OF GROUTING OPERATIONS

This application claims priority pursuant to 35 U.S.C. §§ 119 and 365 to U.S. Provisional Application Serial No. 60/335,887, filed Nov. 2, 2002.

FIELD OF THE INVENTION

The present invention relates to grouting, and more particularly to the field of electronic gathering, monitoring, analyzing, managing, and utilizing of grouting information in order to facilitate and control drilling, testing, installation of grouting materials, and other grouting operations.

BACKGROUND OF THE INVENTION

Grouting is practiced in the construction industry for many purposes. Grouting techniques have been successfully used in many applications including, for example: displacement/densification of soils; stabilization of rock formations; void filling; re-leveling of settled slabs and footings; containment of surface and subsurface water flow; sinkhole remediation and inhibiting further sinkhole development; dam and levee construction; landfill barrier formation; surface subsidence; foundation grouting; driven pile wall re-enforcement; slip liner construction; and tunnel and service conduit reconstruction and abandonment.

There are numerous types of grouts in use today. Grout is typically comprised of a mixture of cement, fly ash, water, and various additives or a solution (chemical) grout such as sodium silicate, acrylates, polyurethanes, etc. The proportions of each ingredient, as well as the selection of additives, can be adjusted to control the grout characteristics such as apparent viscosity (marsh funnel flow time), cohesion, set or gel time, compressive strength, and the like. For example, sodium silicate is commonly used to produce a structural grout suitable for applications involving loose, sandy soils. As the sodium silicate mixture is injected, it permeates the soil resulting in a hardened mass similar to a soft sandstone. The gel time of the sodium silicate can be controlled to limit the radius of influence by modifying the concentrations. Sodium silicate has been effectively used to increase bearing capacity of in-place soils, to underpin existing structures, to control underground water flow, and to provide excavation support of existing structures (or soil) in lieu of sheet piling.

Common methods of installing grout require a sequence of several operations. Typically, holes are first drilled into soil, rock or concrete structures. If the holes are in rock or concrete, the hole is typically washed, then partitioned and tested in stages to evaluate the characteristics of the subsurface conditions. If it is determined that the hole requires treatment, the appropriate type of grout is then injected into the stage or stages of the hole where necessary under controlled pressures. Grout injection continues until the volume of grout injected, reduction in grout flow rate and/or the injection pressures indicate that the stage has been treated satisfactorily. Often times, grouting projects will include several lines of these grout holes and the individual lines may include multiple series of holes, with the distance between the holes on the individual lines becoming successively closer.

As previously described, the monitoring of injection pressures, grout flow rates, and total injected grout volumes on each stage of every hole at the grouting site is critical to the success of a grouting project. Parameters such as pressure and volume are commonly measured using inductive flow meters, pump strokes, transducers, and other known sensors. Common methods of monitoring grouting pressures and volumes involve manual reading, calculation, and recording of pressures and volumes. These manual operations are typically performed by operators at each grouting site, who commonly record data and calculations on paper data sheets. These known methods are labor intensive, and are highly subject to human error. As the number of borings and other grouting sites increase, such as on a large concrete dam, the monitoring of grouting operations becomes exponentially more difficult, resulting in higher labor costs, increased total grouting time, and higher likelihood of error.

Known methods of monitoring grout volume and pressure involve rudimentary electronic monitoring using chart recorders. Traditional chart recorders monitor only a single source, use analog signals, and record resulting data on paper charts. More modern chart recorders provide for electronic monitoring of several data sources (such sensors in grout lines) simultaneously, and can either record data electronically, such as on a memory card, or through a communications link to a personal computer ("PC"). However, in every known method, operators at each grouting site must gather their own information, perform calculations, and manually make adjustments independent of the other grouting sites. Thus, known methods do not facilitate automatic data gathering, calculations, data manipulation, and real- time information sharing between grouting sites. Moreover, known apparatus do not provide a centralized, readily-accessible computerized apparatus for accurate grouting data gathering, manipulation, sharing, and storage.

Therefore, the need exists for a system and method which provide automated, centralized, and readily-accessible gathering, manipulation, sharing, and storage of grouting data. This long-felt need is especially felt at large grouting sites, such as dams, where multiple holes must be monitored and controlled, and where holes have different stages of operational and grouting completion at any given time.

BRIEF SUMMARY OF THE INVENTION

In view of the foregoing, the present invention, through one or more of its various aspects, embodiments and/or specific features or sub-components thereof, is provided to bring about one or more objects and advantages, such as those specifically noted below.

A general object of the present invention is to provide an apparatus and method for gathering, monitoring, analyzing, managing, and utilizing grouting information in order to facilitate and control grouting operations such as drilling, testing, washing, and installation of grouting materials.

A further object of the present invention is to provide an apparatus and method that prevents the loss or destruction of critical job information by replacing the traditional data gathering methods and paper forms associated with each grouting operation with electronic record data gathering and storage that can be easily accessed, reviewed, and manipulated. It is a further object to improve and enhance the quality, efficiency and organization of stored expert knowledge at, for example, a progressive grouting site by storing data in a central database. Still another object is to provide an apparatus and method for searching previously completed grouting operations based on various search criteria.

Yet another object of the invention is to lessen the effort and time required to analyze completed construction work to determine the effectiveness of grouting operations. This can be accomplished by automatic generation of reports by querying the central database and by providing various display screens and viewing modes to display gathered data, including 2-D and 3-D viewing modes, an overhead plan view mode, and an orthographic viewing mode. Other viewing functions which facilitate effective analysis of the grouting installation include, for example, zooming, panning, and rotating.

The present invention, therefore, is directed to a system and method provided for electronically creating a grouting plan, initiating grouting operations pursuant to the plan, monitoring, manipulating, and controlling grouting operations, and storing and retrieving data from said operations. The apparatus and method use electronic apparatus and software to provide a graphical user interface for use by operators involved in all phases of grouting operations.

The apparatus of the present invention is comprised of: at least one sensor which generates signals containing information relating to grouting operations; at least one server equipped with server software, database software, and computer-aided drafting software, which server is linked to said sensor by a communications link; one or more microprocessors having at least one input device, equipment controller software, computer-aided drafting software, and database software, which microprocessor is communicably linked to said server; and one or more display devices communicably linked to said microprocessor.

In other embodiments, the communications link between said sensor and said server is comprised of at least one junction box. In still other embodiments, the communications link may be further comprised of at least one equipment controller hardware, and optionally at least one chart recorder. Optionally, the junction box is also communicably linked to grouting equipment to permit electronic control of said grouting equipment.

In a preferred embodiment, the equipment controller hardware is PlantScape® Controller Hardware. Preferably, the server software is comprised of PlantScape® Process Base Server software, and the server database software comprises Microsoft® SQL Server 7.0 Relational Database software. Preferably, the computer-aided drafting software comprises AutoCAD® software.

In yet additional embodiments of the apparatus, more than one display device is provided, and at least one video switch is communicably linked to each display device to allow selection among said display devices. Preferably, at least one display device is also communicably linked to the server to receive and display information from said server. Optionally, at least one display device is a plasma display device. Moreover, while any known communications means and communications architecture can link the various components of the apparatus, preferably the server and microprocessor are communicably linked in a Transmission Control Protocol/Internet Protocol (TCP/IP) network.

The present invention further comprises a method for electronically creating a grouting plan, and for monitoring and controlling grouting operations. In one embodiment, the method comprises the steps of: providing an apparatus for electronically monitoring, manipulating, and controlling grouting operations; generating and displaying on said apparatus one or more input windows; entering one or more operational grouting parameters into said input windows; and processing said operational grouting parameters to create a grouting plan. In a preferred embodiment, the apparatus used to perform the method is the apparatus of the present invention.

In another embodiment, the method further comprises the step of initiating the grouting plan. The method may further comprise the step of electronically gathering data resulting from grouting operations pursuant to said grouting plan.

In still other embodiments, the parameters are selected from the group comprised of: grouting operational parameters; new project parameters; water test layout; grouting operations layout; mix type controller; head loss factors; pressure parameters; refusal parameters; calibration factors; data parameters; and trends.

In still other embodiments, the method further comprises the step of electronically gathering data resulting from grouting operations pursuant to said grouting plan. Preferably, data resulting from grouting operations are selected from the group consisting of: time; date; flow rate; lugeon value; injection pressure; volume; static head; head loss; stage depth; hole diameter; and hole location. Preferably, grouting operations monitored and controlled by the methods of the present invention are selected from the group consisting of: hole layout; hole definition; hole drilling; hole washing; water testing; grout injection; and grout testing.

In another preferred embodiment of the method of the present invention, each step of displaying input windows on said display device is accomplished by the steps of: generating a first screen display comprising one or more graphs comprising measured or calculated data; selecting one of said graphs; and displaying, in response to the selection of one of said graphs, a second screen display on said display device. Optionally, the method comprises the steps of providing an icon on said display device, and selecting said icon to display, in response to said selection of said icon, a table of data on said display device.

BRIEF DESCRIPTION OF THE SEVERAL VIEWS OF THE DRAWINGS

FIG. 1 illustrates a grouting operation diagram showing the present invention in conjunction with multiple grouting sites having multiple holes, and in conjunction with multiple grout mixing plants.

FIG. 2 illustrates an aerial view of a multiple-line grouting operation depicting various series of holes during grouting operations.

FIG. 3 illustrates a cross-sectional view of a single-line grouting operation depicting various series and stages of holes during grouting operations.

FIG. 4 illustrates a block diagram depicting a preferred embodiment of the apparatus of the present invention, and also depicting connectivity and information flow between various components.

FIG. 5 illustrates the preferred architecture of PlantScape® used in one embodiment of the present invention.

FIG. 6 illustrates a PlantScape® station window in accordance with the present invention.

FIG. 7 illustrates the steps and flow involved in grouting operations and sub-processes thereof in accordance with the present invention.

FIG. 8 illustrates the steps and sequence of operations in accordance with the present invention.

FIG. 9 illustrates the steps and sequence of water test operations in accordance with the present invention.

FIG. 10 illustrates the steps and sequence of grouting operations in accordance with the present invention.

FIG. 11 illustrates a linear-model graphical depiction of head loss as monitored and plotted in accordance with the present invention.

FIG. 12 illustrates a curved-model graphical depiction of head loss as monitored and plotted in accordance with the present invention.

FIG. 13 illustrates a graphical depiction of average lugeon calculation in accordance with the present invention.

FIG. 14 illustrates an AutoCAD® system flowchart in accordance with the present invention.

FIG. 15 illustrates a geologic model in accordance with the present invention.

FIG. 16 illustrates an AutoCAD® geology input text file in accordance with the present invention.

FIG. 17 illustrates an AutoCAD® hole creation menu in accordance with the present invention.

FIG. 18 illustrates an AutoCAD® multiple hole creation menu in accordance with the present invention.

FIG. 19 illustrates the hole geometry definition in accordance with the present invention.

FIG. 20 illustrates the hole angle in accordance with the present invention.

FIG. 21 illustrates the AutoCAD® lugeon color menu in accordance with the present invention.

FIG. 22 illustrates a sample AutoCAD® Water Test display screen with lugeon value color coding based on magnitude in accordance with the present invention.

FIG. 23 illustrates a sample AutoCAD® Water Test display screen with lugeon values and color coding based on magnitude in accordance with the present invention. Although not illustrated, the present invention can also display color-coded grout injection volumes in a similar manner.

FIG. 24 illustrates a sample AutoCAD® grouting operations display screen with radius of grout spread in accordance with the present invention.

FIG. 25 illustrates a sample AutoCAD® grouting operations display screen with radius of grout spread and grout injection volumes in accordance with the present invention.

FIG. 26 illustrates sample AutoCAD® Water Test display screen with lugeon values displayed as cylinders in accordance with the present invention. Although not illustrated, the present invention can also display grout injection volumes or radius of grout spread in a similar 3D manner.

FIGS. 27 through 39 illustrate sample display/input subsystem screens in accordance with the present invention.

DETAILED DESCRIPTION OF THE INVENTION

The present invention is directed to an apparatus and method provided for initiating, monitoring, manipulating, and completing a grouting project through the use of electronic hardware and software which provides a graphical user interface. The apparatus and method can be used by an operator prior to grouting to generate a grouting plan, and can be further used during grouting operations to monitor and control operational parameters, such as the delivery and injection of grouting materials, at one or more grouting sites simultaneously. The apparatus and method also provide for gathering, managing, storing, and distributing grouting information throughout a construction site.

The present invention may be used in a wide variety of grouting operations, and provides a novel solution to enable the simultaneous monitoring and control of a series of grouting operations at different locations. By way of non-limiting embodiments and examples, the present invention will now be described with reference to the production of grout curtains in rock formations.

Referring to FIG. 1, the apparatus of the present invention permits management and control of a progressive grouting site. As shown in FIG. 1 the progressive grouting site is composed of three general areas: the grout injection area; the grout mixing area; and, the grout monitoring area. Multiple operations are conducted within the grout injection area, including drilling of test holes, washing of test holes, water testing of grouting stages, and injection of grout into grout stages. In accordance with the present invention, data are gathered from each of the above described operations, and are stored electronically in a database, thus providing comprehensive, instantaneous access to gathered and stored data, and improving the organization and accessibility of all data, whether current or historic. In addition to data gathering and storage, the present invention enables any combination of the above operations to be monitored, managed, and controlled simultaneously from a central location. For example, while one stage in one test hole may be being pressure tested, another stage in another hole is being grouted, and still other new test holes are being drilled. Simultaneously, within the grout mixing area, grout ingredients are being mixed. Utilizing the present invention, operators at a central location can monitor data from each of these operations, review real-time data, historic data, and trends on display screens, and can effect adjustments to operational parameters for each individual operation simultaneously. By way of non-limiting example, an operator using the present invention can monitor flow rate and injection pressure for a particular test hole, and can effect adjustments to grout mixing operations for grout delivery to that hole in current and future grout stages to meet the particular needs of that particular hole.

The apparatus of the present invention comprises computer software and hardware, including but not limited to one or more display devices communicably connected to a microprocessor which is communicably linked to at least one input device. The microprocessor can be a personal computer (PC), personal digital assistant (PDA), or any known microprocessor. Display devices include, but are not limited to computer monitors, LCD screens, televisions, and other known graphic displays. Input devices are communicably linked to the microprocessor, and include, but are not limited to, sensors and data recorders, keyboards, touchscreens, RF receivers, and other known wired or wireless input devices, and may be manual or automatic. Software is comprised of database software, computer-aided design ("CAD") software, communications software, and graphic user interface software.

In the embodiment illustrated in FIG. 4, the apparatus of the present invention comprises a Data Acquisition and Process Control System (DAPCS). In this embodiment, the DAPCS is used by one or more operators to monitor and control water testing and grouting operations. By way of non-limiting example, as shown in FIG. 4, the DAPCS embodiment is comprised of the following components: 1) one or more signal sources, such as, for example field sensors or grouting equipment having signal transmission capability, which signal sources generate and transmit signals containing information on flow rate, pressure, volume, or other operational parameters; 2) one or more junction boxes, each of which receives signals from field sensors and convey signal information to a chart recorder; 3) one or more chart recorders which receive information from the junction box; 4) PlantScape® Controller Hardware which receives information conveyed from the junction box,; 5) one or more one Performance Servers equipped with PlantScape® Process Base Server, Microsoft® SQL Server 7.0 Relational Database, and AutoCAD® and which receives, stores, and processes information from the PlantScape® Controller Hardware; 6) one or more mini-server PCs equipped with PlantScape® Process Client (Station), AutoCAD(®, and database software, which PCs receive, process, and store information from the Performance Server; 7) one or more monitors which receive and display information processed by the PCs; 8) one or more video switches which allow operators to select particular monitors or a plasma display for display purposes; and 9) a plasma display which receives signals through the video switch from the PCs, and which is communicably linked to the Performance Server to receive and display information from AutoCAD(& on that server. Each component is communicably linked to other components using known communications means, and as illustrated in FIG. 4. Preferably, all computer components are connected in a basic TCP/IP network for internal communication capability and data exchange. The inventors note that the sensor, chart recorder, and junction box are not essential components of the apparatus of the present invention, since grouting equipment having signal outputs may serve to provide the necessary signal for data receipt, processing, and storage by the apparatus.

PlantScape® software is particularly well suited for incorporation into the apparatus of the present invention. PlantScape® software is comprised of supervisory control system software for industrial manufacturing system comprising, computers, electronic calibration and diagnostic apparatus, cabling and sensors; and software which displays, diagnoses, recommends, analyzes, stores, controls, and predicts real time data relating to process instrumentation and equipment.

In the embodiment shown in FIG. 4, the Performance Server provides a real-time database, which interfaces with a Microsoft® SQL Server 7.0 Relational Database. The Relational Database stores operational field data for the generation of reports, for exporting to AutoCAD®, and for archival. As previously mentioned, the microprocessor (shown in FIG. 4 as two mini-server PC's) is equipped with PlantScape® Station and AutoCAD® to provide a user interface, graphical displays and control for operators. The plasma display utilizes AutoCAD® loaded on the Performance Server to graphically display data for the entire grouting project. A video switch is provided to permit operators to swap between the PC monitors and the plasma display.

In this embodiment, the PlantScape(® Human-Machine Interface (HMI)comprises a menu to permit control of applied pressure, and to display the range of pressure (minimum and maximum) that the operator should stay within. The operator can modify these values throughout the grouting and water test operations, as further described herein. As grouting operations commence, sensors such as flow and pressure transducers generate signals from water pressure testing and grouting operations. The signals enter into a chart recorder through a junction box. Preferably, the chart recorder in this embodiment is used for back up of data in the event of a failure of the microprocessor. The PlantScape® Controller Hardware accepts the signals from the chart recorder, relays the signals to the microprocessor, which interprets the signal, displays the interpreted signal information on a display, and stores data associated with the signal. The operator reviews the display, selects parameters for adjustment, and makes parameter adjustments using an input device. Adjustments to the grouting operation can then be made manually, or alternatively, automatically. To make manual adjustments, the operator relays adjustment information to personnel at the grouting site who will adjust the grouting parameters through adjustments of settings on grout pumps or other grouting machinery. To make automatic adjustments, the apparatus must be communicably linked to grouting machinery having electronic controls. In this embodiment, the operator's adjustments are relayed by the microprocessor to the Plant Controller Hardware, which sends an appropriate signal to the grouting machinery's electronic controls to effect the adjustment. By way of non-limiting example, the machine adjustment may involve opening or closing of valves to adjust water or grout flow rate, pressure, volume, and other parameters in accordance with the operator's adjustments.

In addition to display and adjustment of grouting operation parameters, the DAPCS provides a fully functional data collection and control system using SQL Server 7.0 for the storage of data and PlantScapet hardware, software and integration services. Additional functionality incorporated into the system preferably comprises graphical display of geology, hole geometry, water test, and grouting data in AutoCAD®. The apparatus further utilizes current and past data to calculate recommended ranges for critical operational variables such as injection pressure, and water and grout volume for each stage of each particular hole.

Operator interaction with the DAPCS is through a Human-Machine Interface (HMI). The PlantScape® Station program provides the HMI for the PlantScape® server. This HMI is a full graphics windowing system capable of supporting the diverse requirements of the DAPCS system. It will present users with an intuitive, consistent and flexible interface based on Microsoft Windows®. When the PlantScape® station program is running, it provides a "window" in which it displays the data requested by the operator. The station window has the following main features (also illustrated in FIG. 6):

| | |
|---|---|
| Title Bar | Shows current station set-up file, page title, and the page name or number being displayed. |
| Menu Bar | This consists of a series of pull down menus including Station, Edit, Schematic, View, Control, Action, Configure and Help. |
| Tool Bar | A row of graphical pushbuttons that perform a variety of display and control functions. |
| Message Zone | An area of the screen where PlantScape ® server prompts for data input or displays messages. |
| Command Zone | An area used for entering commands and responding to prompts for data input. |
| Display Region | The greatest portion of the screen displaying either a system page or a custom graphic. |
| Navigation Bar | Displays hyperlinks to other pages. Always visible on configuration pages, but not on all operations pages. |
| Status Line | Displays current system status information including server date and time, server hostname, station number and security access level. |

In a preferred embodiment, DAPCS provides a main menu page having links to integrated input/display subsystems including, but not limited to: 1) Project Definition; 2) Water Test Data; 3) Grouting Data; 4) Mix Type Controller; 4) Head Loss Factors; 6) Cart Parameters; 7) Cart Calibration; 8)Hole Definition. Each of these input/display subsystems is programmed to monitor, control, and display data from at least one grouting operation. The nature and function of each of these display/input subsystems will now be described in greater detail.

In the embodiment illustrated in FIG. 28, the Project Definition display/input subsystem generates and displays project parameters information on the display device. An input device is provided for entering and selecting parameters based on the information displayed on the display device. In addition, the subsystem comprises a project parameters storage system for storing the project parameters based on the parameters entered and selected by the input device.

In the embodiment illustrated in FIGS. 34, 35, and 36, the Water Test Data display/input subsystem generates and displays water pressure testing information on the display device. An input device is provided for entering water test layout information, water stage definition and modification information and for generating and displaying trend plots of the gathered real-time pressure, flow rate and lugeon value data on the display device. The water pressure testing information is displayed by the water test data display system through a series of successively displayed screen displays, whereby at least one of the successively displayed screen displays is displayed based on a previous selection by the input device. In addition, the water test data display/input subsystem comprises a water testing storage system for storing the water test data that was gathered and the information entered and selected by the input device.

In the embodiment illustrated in FIGS. 37, 38 and 39, the Grouting Data display/input subsystem generates and displays grouting operation information on the display device, and an input device is provided for entering grouting information, grout stage definition and modification information and for generating and displaying trend plots of the gathered real-time injection pressure, flow rate, apparent lugeon and mix type on the display device. The displayed grouting information is displayed by the grouting data display/input subsystem through a series of successively displayed screen displays, whereby at least one of the successively displayed screen displays is displayed based on a previous selection by the input device. In addition, the grouting data display/input subsystem comprises a grouting data storage system for storing the grouting data that was gathered and the information entered and selected by the input device.

In the embodiment illustrated in FIG. 33, the Mix Type Controller display/input subsystem generates and displays grout mix information on the display device, and an input device is provided for entering and selecting information based on the information displayed on the display device. In addition, the subsystem comprises a mix type controller storage system for storing the grout mix information based on the information entered and selected by the input device.

In the embodiment illustrated in FIG. 32, the Head Loss Factors display/input subsystem generates and displays head loss information on the display device, and an input device is provided for entering and selecting information based on the information displayed on the display device. In addition, the subsystem comprises a head loss factors storage system for storing the head loss information based on the information entered and selected by the input device.

In the embodiment illustrated in FIG. 30, the Cart Parameters display/input subsystem generates and displays pressure and flow parameter information on the display device, and an input device is provided for entering and selecting information based on the information displayed on the display device. In addition, the subsystem comprises a pressure and flow parameters storage system for storing the pressure and flow parameters information based on the information entered and selected by the input device.

In the embodiment illustrated in FIG. 31, the Cart Calibration display/input subsystem generates and displays cart calibration factors on the display device, and an input device is provided for entering and selecting information based on the information displayed on the display device. In addition, the subsystem comprises a cart calibration factors storage system for storing the cart calibration factors based on the information entered and selected by the input device.

In the embodiment illustrated in FIG. 29, the Hole Definition display/input subsystem generates and displays hole definition information on the display device, and an input device is provided for entering and selecting information based on the information displayed on the display device. In addition, the subsystem comprises a hole definition storage system for storing the hole definition information based on the information entered and selected by the input device.

In the embodiment illustrated in FIG. 27, the Database Administration display/input subsystem generates and displays database administration option on the display device, and an input device is provided for entering and selecting information based on the information displayed on the display device. In addition, the subsystem comprises a hole definition storage system for storing the hole definition information based on the information entered and selected by the input device.

In a preferred embodiment of DAPCS, each workstation monitor displays a different page, and any combination of pages can be selected and displayed by the operator. For example, one monitor can display the grouting operation page, while another monitor simultaneously displays the trend page. Preferably, pages appear in windows which may be layered over other displayed pages using Windows-type display technology. Pages being displayed are refreshed with real-time data, and the refresh rate is determined and adjusted through input by the operator. Each page preferably contains all of the information required to effectively monitor each grouting operation, and all displays preferably appear in a consistent location and size so as not to inappropriately obstruct any other displays.

Navigation within the software of the apparatus is driven using any known input device such as, for example, a keyboard, mouse, trackball, or touchscreen. Navigation and access to displays and popup menus is preferably provided through on-screen or keyboard buttons, or active areas on displays. Preferably, pop-up menus are spawned by displayed pages, but are automatically dismissed upon the dismissal of the parent display.

Additional preferred features provided by the software of the present apparatus comprise:

1) Capturing a snapshot of the existing data set to enable two parties with the same apparatus to exchange database information. Using this feature, a snapshot of the existing data set can then be taken from one system and reloaded onto the other system.
2) Saving the entire database for system recovery—a backup process is a function of the database—this is required so that in the event of a complete system failure, the database backup will provide the necessary files to resume the system functionality.
3) Transferring data to static AutoCAD® files—dynamic data is available for importing into AutoCAD®. From the dynamic data, AutoCAD® will create static drawings for saving and transmitting to other parties. An Open Database Connectivity (ODBC) Data Exchange can be used to enable data to be transferred between the SQL Server and AutoCAD®.
4) Transferring data to Excel® Spreadsheets—data and trends can be imported into Excel® for further analysis and/or forwarding to third parties. This transfer of data is enabled via ODBC.

Computer-aided drafting software, preferably AutoCAD®, is integrated into the apparatus of the present invention in several ways. The system allows the importation of some graphic information from others to the system. Underlying geologic details or site survey information can be included in the graphic reports generated by the system. Additionally, a graphical representation of the hole/stage layout and associated geologic details or site survey data can be transmitted to others through the use of AutoCAD® files. As previously described, data collected by the data acquisition system will be stored in the DAPCS system database files.

In accordance with the present invention, AutoCAD® is integrated to provide a combination of both 2D and 3D graphic display representations that may be either static, with no active database points attached, or dynamic, with real-time data displayed. In a preferred embodiment, AutoCAD® will be installed on each operator station, as well as on the server.

The function of AutoCAD® is to create an initial topographic drawing upon which the borehole geometry data will be displayed. The site topography is displayed as a 3D digital terrain model ("DTM"). To define the DTM, the operator enters a series of points having x, y, and z coordinates with respect to a pre-defined reference point. AutoCAD® then interpolates between the points to define the contours and elevations of the earth's surface, creating a 2D or 3D model. AutoCADO permits the operators to rotate the 3D model to view the site from different angles, and to slice a 3D model in any plane to obtain a 2D model (topographic profile) of the site geology. For example, a slice in the z-plane yields the profile shown in FIG. 15.

After a DTM is created, the operator uses AutoCAD to create a 2D horizontal alignment representing the bore hole lines in plan view. So that the elevations of the profile can be retrieved from the 3D lines in the DTM, alignments are generally drawn within the footprint of the 3D digital terrain model. AutoCAD will assign a default color to visually identify different alignments in plan and profile views. Using AutoCAD, the operator next writes the horizontal alignment to the DAPCS system database to be saved for future retrieval.

When an alignment is created and defined in the current drawing, the user generates a profile from the 3D topography. The user is prompted by AutoCAD to name the alignment, select which end of the alignment is the beginning, and select the lower and upper datum elevations. The operator then populates the topographical profile drawing with holes as described in a later section.

In the present invention., the operator uses AutoCAD® to automatically create one drawing layer for each line specified. By way of non-limiting example, separate layers are created for the primary, secondary, tertiary, etc. holes associated with each line, 1 layer for each geologic formation, 2 layers for the DTM, and 1 layer for the vertical and horizontal scale. AutoCAD® has the capability of displaying at least 256 layers.

Geologic formations below the topographical surface can be input as a text file in AutoCAD and viewed as 2D lines in the profile. The input text file as depicted in FIG. 16, allows the operator to enter the associated formation of the geologic layer for each data point. For each formation, the operator specifies a name for the formation, stationing and elevation, and AutoCAD color.

When a hole is created, AutoCAD® determines the intersections of the hole with the geologic layers. AutoCAD® saves this information to the DAPCS system database.

After the geological formations are created, the operator creates and defines holes along the 2D alignment profile. There are two types of bore holes which are drawn in AutoCAD. Design bore holes are bore holes created in AutoCAD only and are white in color. Database bore holes are bore holes that have been written to the database and are distinguished by the colors associated with the hole series in which the bore hole was created in; such as, primary, secondary, tertiary, or quaternary. Database bore holes are shown as a dashed line in AutoCAD when not drilled, and a solid line when drilled.

The operator next populates the 2D-drawing with the holes by: 1) selecting New Design Boreholes in the Intelli-Grout Main Menu; 2) selecting a profile Pollyanna (2D alignment profile) that operator would like to populate with holes; 3) pick a point within the current profile along the topographical surface; 4) dialogue box shown in FIG. 17 will then appear. The dialogue box will prompt operator to enter hole series prefix, bore hole name, bore hole angle, bore hole length with respect to geology or elevation, and starting station. AutoCAD automatically recognizes the 2D alignment name when creating new bore holes.

In a preferred embodiment, AutoCAD® permits automatic creation of multiple holes at one time. For example, the operator inputs one point along the surface of the 2D-alignment profile, and AutoCAD® automatically draws a specified number of holes, equally spaced beginning at a specified station. A sample interface for this function is illustrated in FIG. 18. In this case, the holes would belong to one category (primary, secondary, etc) and would have the same overall properties, as per the basic hole/stage geometry described below.

Once bore holes are created, bore holes must be written to the database to provide hole information for viewing or modifying in hole definition screen of HMI. Once the bore hole is written to the database, the color of the bore hole will change automatically according to the color convention associated with the hole series in which the bore hole was created.

Hole elevation is the point on the ground surface where the hole starts. It preferably is a floating-point number with 1 significant digit. The Set 1 units for hole elevation is preferably meters (m). The Set 2 units is preferably feet (ft). Hole elevation must be a positive value. AutoCAD® automatically populates the value for hole elevation based on the ground surface point selected by the operator when drawing the hole. The DAPCS system permits the operator to manually modify this parameter for individual holes if required.

Bore holes that are washed, pressure tested, or grouted, are time stamped in the hole definition screen of HMI by the operator. AutoCAD assigns default icons for washed, pressure tested, or grouted bore holes and appear in the 2D alignment profile above the bore hole ID.

In one embodiment, active holes are updated with real-time information, such as lugeon values during water testing, and radius of grout spread and accumulated grout take during grouting operation, and is only available in 2D displays. Stage lengths, depths, and numbers, are created during water testing or grouting by the operator in HMI. Hole geometry is shown in FIG. 19. Hole geometry parameters such as hole elevation, hole angle, and length of hole can be modified in the hole definition screen by the operator in HMI. These edits are written to the DAPCS system database and are recognized by AutoCAD.

Adding or deleting entire holes in AutoCAD® is permitted in accordance with the present invention. The operator is prompted to select a profile polyline, followed by database borehole to delete. However, when making changes to a borehole, the naming conventions of other boreholes is not affected. Data for all changes is sent to the system database for storage.

As previously discussed, displays are preferably a combination of 2D and 3D. The AutoCAD® system has the ability to create cross sections of the 3D models in any plane to provide the 2D drawings. In addition, the system is able to create 3D models from the 2D cross sections (with the assumption that one plane is fixed). Also, all drawing layers are configured for zooming in and out to highlight certain areas of the displays, and rotating for view from different angles.

A description of each display is provided below. Note that displays are not independent, that is, the user may choose to view one display or a number of the displays simultaneously. For example, the user is able to view both the water test and grouting data for a particular line simultaneously.

3D-Display

In the preferred embodiment, one monitor is preferably used for a 3D AutoCAD® display. The purpose of this display is to graphically represent all available information for a given project. The preferred displays comprise the following: 1) Digital Terrain Model; 2) Hole And Stage Models Belonging to Different Lines; 3) Static Hole and Stage Water Test Data; 4) Static Hole and Stage Grouting Operation Data.

Digital Terrain Model

A 3D-Digital Terrain Model, as created by the operator, is displayed, with the location of any point on the terrain (x,y,z value) be available by clicking the cursor at the point of interest. The user enters a command (pushbutton, menu selection) to automatically view the model from the following perspectives: 1) Top view; 2) Side view (right); 3) Side view (left). The basic rendering functions provided for by AutoCAD® can be used for enhanced presentation of the model. Customized rendering functions provided for by 3D Studio VIZ are also an option.

Hole and Stage Models Belonging to Different Lines

Holes and stages of the various lines are displayed in 3D. Each line is on a separate layer in the drawing file, and AutoCAD® provides commands to manually turn selected layers on or off. The graphics display system comprises a menu function and/or command line entry for the user to request the graphics system to switch between displayable configurations of layers, for example, all, Layers 1 & 2, or Layers 1 & 3. Each line is composed of holes that are categorized as primary, secondary, tertiary etc, and all holes belonging to a category are preferably displayed in the same color (for example, all displayed in primary red, all secondary blue.) The operator is also able to select the type of hole to view (for example, only primary holes on all lines, or only secondary holes on Lines 1 & 2.)

Stages are preferably modeled as cylinders, and holes as a series of stages connected vertically.

AutoCAD® also provides the ability to generate horizontal alignments along the lines of holes. These alignments can be used to create 2D profile drawings.

Static Hole and Stage Water Test Data

For each stage, the water test information, namely Lugeon value is represented on the 3D display as a scaled wire frame cylinder. The wire frame is be drawn in a particular color as assigned to the stage during water test.

Static Hole and Stage Grouting Operation Data

For each stage, the grouting operation data, namely radius of grout spread is represented on the 3D display as a scaled solid cylinder. A numerical value for accumulated grout take is shown within the scaled solid cylinder.

2D-Display

From the 3D DTM display, 2D representations are preferably available. The 2D representations provide the main interfaces to be used by operators in their daily operations of the system. The 2D displays preferably comprise the following: 1) Topographic Surface; 2) Hole / Stage Profiles; 3) Static Drill Hole and Washing Data Display; 4) Static Water Test Display; 5) Dynamic Water Test Display; 6) Static Grouting Operation Display; and 7) Dynamic Grouting Operation Display. A description of each display is provided below. Again, note that the displays are not independent, that is, the user may choose to view one display or a number of the displays simultaneously.

Topographic Surface

The 3D digital terrain model defined by the user will be displayed as a 2D topographic surface. A vertical scale indicating elevation and grid lines will be placed on a separate layer thereby permitting it to be turned on or off. In addition, the elevation at each point on the geology will be available by operator selection.

Hole/Stage Profiles

The hole/stage profile layer displays the holes and stages of the various lines of holes. Like the 3D model, each line appears on a separate layer in the drawing file. AutoCAD®'s existing commands can be utilized to manually turn selected layers on or off. The graphics display system provides a menu function and/or command line entry for the user to request the graphics system to switch between displayable configurations of layers, for example, all, Layers 1 & 2, or Layers 1 & 3. Again, each line is composed of holes that are categorized as primary, secondary, tertiary etc., and all holes belonging to a category should be the same color (for example, all primary red, all secondary blue.) The operator can select the type of hole to view (for example, only primary holes on all lines, or only secondary holes on Lines 1 & 2). A horizontal scale indicating true distance from a reference point are preferably on a separate layer thereby enabling it to be turned on or off. In addition AutoCAD® enables an operator to calculate and display the distance between any 2 points.

Static Drill Hole and Washing Data Display

As in the 3D display, holes that have been drilled are distinguished from "undrilled" or planned holes by display in a specific color. Likewise, holes that have been washed will have an icon displayed above hole. Again, a flag in the DAPCS system database will distinguish drilled from "undrilled" and washed from "unwashed" holes.

Static Water Test Display

The static water test display provides several functions and features: 1) display the geologic data in the background layer; 2) display the hole geometry in the foreground layer for all lines, a selected line, or a selected group of lines; 3) display a hole as a 2 dimensional bar ; 4) at the end of the water testing operation, place a label of average water Lugeon value for that stage to the middle of the applicable stage entity; 5) assign a color to the stage based on the average water Lugeon value as specified in the Lugeon Color popup menu shown in FIG. 21. Note that this menu preferably allows a maximum of 10 Lugeon values, but is configurable on a job by job basis; 6) Update the 3D drawing with the water test information.

Dynamic Water Test Display

In addition to the static requirements, the water test display reads the water Lugeon value as calculated by DAPCS from the DAPCS system database for a maximum of 8 active holes at one time, and displays the water Lugeon value as a 2D expanding wire frame for the stage that is being water tested. The size of the wire frame is related to radius of grout spread by a scale factor. AutoCAD® provides the flexibility for the operator to perform a window zoom on a particular stage to in effect adjust the scale for each individual stage if and as required. The water test display also shows the numerical value of the water Lugeon value for a stage to the middle of the applicable stage entity. The water Lugeon value to be displayed will be calculated by DAPCS and stored as a value in the DAPCS system database. AutoCAD® polls the database for values and will update the drawing for active holes. An example of a water test AutoCAD® display is shown in FIG. 22.

Static Grouting Operation Display

The grouting operation provides several functions, including but not limited to: 1) display of the geologic data in the background layer; 2) display of the hole geometry in the foreground layer for all lines, a selected line, or a selected group of lines; 3) display of a hole as a 2 dimensional bar; 4) display of the radius of grout spread as a 2D scaled solid bar for each stage; 5) show of gaps in the grout curtain by displaying the background color; 6) display of the numerical value for volume of grout take for each stage; 7) update of the 3D drawing with the grouting operation information.

Dynamic Grouting Operation Display

In addition to the static requirements, the grouting operation display: 1) reads the radius of grout spread and the volume of grout take calculated by DAPCS from the DAPCS system database for a maximum of 8 active holes at one time; 2) displays the radius of grout spread as an expanding 2D scaled solid bar for each stage being injected. The radius increase to be displayed will be calculated by DAPCS and stored as a value in the DAPCS system database. AutoCAD® polls the DAPCS system database for values and update the drawing for active holes. Moreover, the dynamic grouting operation display displays the volume of grout take from the DAPCS system database for the stage being injected as a numerical value that updates as volume increases. (Same database polling mechanism as for the radius of grout spread.) An example of a grouting operation AutoCAD® display is shown in FIG. 24.

Querying Capability

Water testing and grouting operation data are respectively stored in the DAPCS system database, preferably in "WaterTestOperation" and "GroutingOperation" tables. The date completed for each operation is also stored in the DAPCS system database. AutoCAD® provides the ability to display the water testing and grouting operation data based on a query by date and time. For example, operation data for the entire project (such as radius of grout spread, accumulated grout take, water Lugeon value) are displayed if the operator queries from the start of data collection to the current date. Likewise, a sub-set of data is displayable from one date and one time to another. The same operator interface is applicable to both scenarios.

Data Export

Static drawings are retrievable from AutoCAD® of the present invention for reporting and exchanging with others. Preferably: 1) all project drawings/data files are updated at the end of the water test operation; 2) all project drawings/data files are updated at the end of the grouting operation; 3) AutoCAD® provides the capability to save snapshots or static images of the drawings in softcopy format; 4) drawings are selectively printed in hardcopy format on a printer or plotted with a border and title block for reports and presentations.

Video Switching

For effective process monitoring, the PlantScape Stations preferably have the capability of displaying data on several monitors (flatscreen and plasma) simultaneously. This is preferably accomplished using a multi-display graphics card, such as the Matrox G200, which runs on Windows NT®b 4.0 and supports up to a maximum of 16 monitors from one workstation. In this embodiment, the card has two forms, digital or analog, however, the monitors are all of the same type—whether digital (flat panel) or analog (CRT). The Matrox card is also compatible with digital monitors that have a DVI-D connector.

Security

In accordance with the present invention, each operator workstation may be configured to limit the functions available to different operators: 1) Station Based Security; and 2) Operator Based Security. The selection of which security mode is used is made during the hardware build process for each individual workstation. In a preferred embodiment, Operator Based Security provides 6 levels of access: 1) Level 1 (Lvl1); 2) Level 2 (Lvl2); 3) Operator (Oper); 4) Supervisor (Supv); 5) Engineer (Engr); 6) Manager (Mngr). In this embodiment, each operator has a unique ID, a password, and is assigned to one of the 6 levels and to a control level, control level being a number. Every point built in a PlantScape® server also has a control level assigned to it. In order to be able to control a point an operator must have a control level equal to or greater than the control level of the point.

Table 1 indicates preferred actions that provided for each security level, irrespective of whether Station Based or Operator Based security is implemented.

TABLE 1

SECURITY ACCESS LEVELS

| Actions Allowed | Lvl 1 | Lvl 2 | Oper | Supv | Engr | Mngr |
|---|---|---|---|---|---|---|
| View Startup page | | | | | | |
| Display pages | | | | | | |
| Request Reports | | | | | | |
| Acknowledge Alarms | | | | | | |
| Peruse files | | | | | | |
| Change Service or Status | | | | | | |
| Point control | | | | | | |
| Change Oper level fields | | | | | | |
| Use most configuration pages | | | | | | |
| Build reports | | | | | | |
| Change point engineering parameters | | | | | | |
| Assign function keys | | | | | | |
| Assign print functions | | | | | | |
| Change system wide configuration | | | | | | |
| Change Supv level fields | | | | | | |
| Change Engr level fields | | | | | | |
| fields | | | | | | |
| Assign areas to stations | | | | | | |
| Display pages and points outside area | | | | | | |
| Change Mngr level fields | | | | | | |

Business Rules

The following business rules are adhered to in the preferred embodiment of the DAPCS system: 1) All stages must belong to a hole; 2) a maximum of 8 operations (water testing and grouting combined) may be conducted simultaneously; 3) Stages are grouted from the lowest elevation upwards (the apparatus does allow an exception for downstaging operations.)

Methods of the Invention

According to another aspect of the invention, methods are provided for electronically monitoring and controlling various grouting operations. By way of non-limiting example, with respect to water testing a drilled hole, one method comprises the steps of: providing computer software and hardware comprising one or more display devices communicably connected to a microprocessor which is communicably linked to at least one input device; generating and displaying a project definition input window on a display device; entering, with an input device, a project description and project parameters; generating and displaying a mix type controller input window on a display device; selecting, with an input device, mix type parameters based on the information displayed on the display device; generating and displaying head loss factors input window on a display device; entering, with an input device, head loss factors based on the information displayed on the display device; generating and displaying cart parameters input window on a display device; selecting, with an input device, cart parameters based on the information displayed on the display device; generating and displaying cart calibration factors input window on a display device; selecting, with an input device, cart calibration factors based on the information displayed on the display device; generating and displaying hole definition input window on a display device; selecting, with an input device, hole definition based on the information displayed on the display device; generating and displaying a water test data input window on a display device, entering, with an input device water test parameters; initiating testing and data gathering; and storing, in a storage device, the gathered data for the stage of the hole that was water tested.

According to yet another aspect of the invention, a method is provided for electronically monitoring and controlling the injection of grout into a hole. The method comprises the steps of: providing computer software and hardware comprising one or more display devices communicably connected to a microprocessor which is communicably linked to at least one input device; generating and displaying a project definition input window on the display device; entering, using an input device, a project description and project parameters; generating and displaying mix type controller input window on a display device; selecting, with an input device, mix type parameters based on the information displayed on the display device; generating and displaying head loss factors input window on a display device; entering, with an input device, head loss factors based on the information displayed on the display device; generating and displaying cart parameters input window on a display device; selecting, with an input device, cart parameters based on the information displayed on the display device; generating and displaying cart calibration factors input window on a display device; selecting, with an input device, cart calibration factors based on the information displayed on the display device; generating and displaying hole definition input window on a display device; selecting, with an input_ device, hole definitions based on the information displayed on the display device; generating and displaying a grouting data input window on a display device, entering, with an input device grouting data; initiating testing and data gathering; and storing, in a storage device, the gathered data for the stage of the hole that was grouted.

In yet another embodiment, the method of the present invention provides for displaying of grouting information using a computerized apparatus to generate and navigate through a series of successively displayed screen displays, wherein at least one of the successively displayed screen displays is displayed based on a previous selection entered using the input device. The step of displaying can be accomplished on the display device through generation of a first screen display comprising a plurality of graphs comprising each measured or calculated data. Optionally, the method may also comprise the steps of selecting one of the graphs with the input device and displaying, in response to the selection of one of the graphs, a second screen display on the display device. Optionally, the method may further comprise the step of providing shortcuts such as an icons, selecting one or more icons with the input device to display, in response to the selection of one of the icons, a table of data on the display device.

Further features and/or variations of the invention are contemplated herein, and are included in addition to the features and variations. For example, the inventors contemplate various combinations and sub-combinations of the above-described features' elements, and steps or combinations and sub-combinations thereof to accomplish: real-time monitoring; real-time presentation and reporting of data; query capability of the database; visual and graphical presentation of data; improved quality of data; improved quality of graphical reports; more user-friendly program; reduced effort to generate reports; better quality end product (grout curtain); lower overall project cost; and improved grouting and construction schedules.

What is claimed:

1. A method for electronically generating a grouting plan, and for monitoring and controlling grouting operations, comprising the steps of:

providing an apparatus for electronically monitoring, manipulating, and controlling grouting operations;

generating and displaying on said apparatus one or more input windows;

entering one or more parameters into said input windows; and processing said parameters to create a grouting plan.

2. The method of claim 1, wherein the grouting plan comprises computer instructions for monitoring, manipulating, and controlling grouting operations.

3. The method of claim 1, wherein said parameters are selected from the group comprised of: project definition; water test data; grouting data; mix type controller; head loss factors; cart parameters; cart calibration; and hole definition.

4. The method of claim 2, further comprising the steps of initiating the grouting plan and electronically gathering data resulting from grouting operations pursuant to the grouting plan.

5. The method of claim 4, wherein said data resulting from grouting operations are selected from the group consisting of: time; date; flow rate; lugeon value, injection pressure; volume; static head; head loss; stage depth; hole diameter; and hole location.

6. The method of claim 4, wherein said grouting operations are selected from the group consisting of: hole layout; hole definition; hole drilling; hole washing; water testing; grout injection; and grout testing.

7. The method of claim 1, wherein the apparatus is comprised of: at least one sensor which generates signals containing information relating to grouting operations; at least one server equipped with server software, database software, and computer-aided drafting software, which server is linked to said sensor by a communications link; one or more microprocessors having at least one input device, equipment controller software, computer-aided drafting software, and database software, which microprocessor is communicably linked to said server; and one or more display devices communicably linked to said microprocessor.

8. The method of claim 7, wherein said communications link between said signal source and said server is comprised of at least one junction box.

9. The method of claim 8, wherein said communications link between said signal source and said server is further comprised of at least one equipment controller hardware.

10. The method of claim 9, wherein said communications link between said signal source and said server is further comprised of at least one chart recorder.

11. The method of claim 8, wherein said junction box is also communicably linked to grouting equipment to permit electronic control of said grouting equipment.

12. The method of claim 7, wherein each step of displaying input windows on said apparatus is accomplished by the steps of:

generating a first screen display comprising one or more graphs comprising measured or calculated data;

selecting one of said graphs; and displaying, in response to the selection of one of said graphs, a second screen display on said display device.

13. The method of claim 12, further comprising the steps of:

providing an icon on said display device; and, selecting said icon to display, in response to said selection of said icon, a table of data on said display device.

14. A method of electronically monitoring and controlling grouting testing and grouting operations, the method comprised of the steps of:

providing one or more display devices communicably connected to a microprocessor, the microprocessor communicably linked to at least one input device;

generating and displaying a project definition input window on a display device;

entering, using the input device, a project description and project parameters;

generating and displaying a mix type controller input window on the display device;

selecting, using the input device, mix type parameters based on information displayed on the display device;

generating and displaying a head loss factors input window on the display device;

entering, using the input device, head loss factors based on information displayed on the display device;

generating and displaying a cart parameters input window on the display device;

selecting, using the input device, cart parameters based on the information displayed on the display device;

generating and displaying a cart calibration factors input window on the display device;

selecting, using the input device, cart calibration factors based on information displayed on the display device;

generating and displaying hole definition input window on a display device;

selecting, using the input device, hole definition based on information displayed on the display device;

generating and displaying a water test data input window on the display device;

entering, using the input device, water test parameters;

initiating the water test and gathering resulting data; and storing the resulting water test data.

15. The method of claim 14, further comprised of the steps of:

generating and displaying a grouting data input window on a display device;

entering, using the input device, grouting data;

initiating grouting installation and gathering resulting data; and storing the resulting grouting installation data.

* * * * *

UNITED STATES PATENT AND TRADEMARK OFFICE

CERTIFICATE OF CORRECTION

PATENT NO. : 6,801,814 B1
DATED : October 5, 2004
INVENTOR(S) : Wilson et al.

It is certified that error appears in the above-identified patent and that said Letters Patent is hereby corrected as shown below:

Column 11,
Line 28, "AutoCADO" should be -- AutoCAD® --

Column 16,
Line 4, "NT®b 4.0" should be -- NTΘ 4.0 --

Signed and Sealed this

Second Day of August, 2005

JON W. DUDAS
*Director of the United States Patent and Trademark Office*